US009523327B2

(12) United States Patent
Shinomiya et al.

(10) Patent No.: US 9,523,327 B2
(45) Date of Patent: Dec. 20, 2016

(54) SOOT ACCUMULATION COMPUTING AND DISPLAYING DEVICE

(71) Applicant: ISEKI & CO., LTD., Ehime-ken (JP)

(72) Inventors: Toru Shinomiya, Ehime-ken (JP); Kenji Adachi, Ehime-ken (JP); Naohiro Fukuyama, Ehime-ken (JP); Shinji Okubo, Ehime-ken (JP)

(73) Assignee: ISEKI & CO., LTD., Ehime-Ken (JP)

( * ) Notice: Subject to any disclaimer, the term of this patent is extended or adjusted under 35 U.S.C. 154(b) by 816 days.

(21) Appl. No.: 13/933,493

(22) Filed: Jul. 2, 2013

(65) Prior Publication Data

US 2014/0019025 A1 Jan. 16, 2014

(30) Foreign Application Priority Data

Jul. 13, 2012 (JP) ..... 2012-157332
Jun. 27, 2013 (JP) ..... 2013-135504

(51) Int. Cl.
*F02D 45/00* (2006.01)
*F02D 41/02* (2006.01)
*F02D 41/22* (2006.01)

(52) U.S. Cl.
CPC ..... *F02D 45/00* (2013.01); *F02D 41/029* (2013.01); *F02D 2041/228* (2013.01);
(Continued)

(58) Field of Classification Search
CPC .... F01N 3/0232; F01N 9/002; F01N 2250/04; F01N 2900/04; F01N 2900/0418; F01N 2900/0601; F01N 2900/08; F01N 2900/1606;F01N 2900/1611; F02D 41/1466; F02D 41/1467; F02D 2041/228
See application file for complete search history.

(56) References Cited

U.S. PATENT DOCUMENTS 8,460,625 B2 * 6/2013 Takayanagi ..... B01D 46/0063 422/105
8,936,760 B2 * 1/2015 Takayanagi ..... F01N 9/002 422/169
(Continued)

FOREIGN PATENT DOCUMENTS

JP 11-132026 5/1999
JP 2006-29092 2/2006
(Continued)

*Primary Examiner* — Erick Solis
*Assistant Examiner* — Anthony L Bacon
(74) *Attorney, Agent, or Firm* — Wenderoth, Lind & Ponack, L.L.P.

(57) ABSTRACT

A soot accumulation computing and displaying device, including: a first calculating part that is configured to calculate a first inferred value of a present accumulation amount of the soot, based on a main fuel injection amount and a post fuel injection amount; a second calculating part that is configured to calculate a second inferred value of a present accumulation amount of the soot, based on a driving time of the internal-combustion engine, which is estimated to a present time from a starting time of a latest regeneration processing of the filter among regeneration processings of the filter conducted in past; a determining part that is configured to determine a maximum inferred value among the first and second inferred values; and a displaying part that is configured to perform displaying with regards to the maximum inferred value determined by the determining part.

6 Claims, 23 Drawing Sheets

(52) U.S. Cl.
CPC ..... *F02D 2200/0614* (2013.01); *F02D 2200/0812* (2013.01); *F02D 2200/604* (2013.01)

(56) References Cited

U.S. PATENT DOCUMENTS

2003/0106309 A1* 6/2003 Morimoto ..... F01N 3/0231 60/295
2006/0260298 A1* 11/2006 Iida ..... F01N 9/002 60/297
2006/0272320 A1* 12/2006 Kim ..... F01N 9/002 60/295
2008/0184696 A1* 8/2008 Wyatt ..... F02D 41/029 60/286
2009/0055076 A1* 2/2009 Onishi ..... F02D 41/1458 701/103
2009/0188241 A1* 7/2009 Sugiarto ..... F01N 3/023 60/295
2010/0126145 A1* 5/2010 He ..... F01N 9/002 60/286
2012/0282159 A1 11/2012 Takayanagi et al.
2012/0288410 A1* 11/2012 Takayanagi ..... F01N 9/002 422/105
2013/0081444 A1* 4/2013 Vartia ..... F02D 41/1467 73/23.33
2014/0251146 A1* 9/2014 Noguchi ..... F02D 41/029 96/397
2014/0318883 A1* 10/2014 Noguchi ..... E02F 9/0866 180/309

FOREIGN PATENT DOCUMENTS

JP 2009-91915 4/2009
JP 2010174794 A * 8/2010
JP 2011-153617 8/2011
JP 2011-157924 8/2011
JP 2011-163199 8/2011

* cited by examiner

FIG.7

| METER GAUGE INDICATION | ACCUMULATION DEGREE | RANGE | NUMERICAL RANGE |
|---|---|---|---|
| 8(Flash Fast) | 15 | EXCESS ACCUMULATION (SERVICE REGENERATION PROCESSING) RANGE | ≧F |
| 8(Flash Slow) | 14 | EXCESS ACCUMULATION (SERVICE REGENERATION PROCESSING) RANGE | ≧E |
| 8 | 13 | MANUAL-REGENERATION-PROCESSING RANGE (LATTER PERIOD) | ≧D |
| 7 | 12 | MANUAL-REGENERATION-PROCESSING RANGE (FORMER PERIOD) | ≧C |
| 6 | 11 | AUTOMATIC-REGENERATION-PROCESSING RANGE (LATTER PERIOD) | ≧(B+C)÷2 |
| 5 | 10 | AUTOMATIC-REGENERATION-PROCESSING RANGE (FORMER PERIOD) | ≧B |
| 4 | 9 | ORDINARY RANGE | ≧A+(B−A)÷9×8 |
| | 8 | | ≧A+(B−A)÷9×7 |
| | 7 | | ≧A+(B−A)÷9×6 |
| 3 | 6 | | ≧A+(B−A)÷9×5 |
| | 5 | | ≧A+(B−A)÷9×4 |
| 2 | 4 | | ≧A+(B−A)÷9×3 |
| | 3 | | ≧A+(B−A)÷9×2 |
| 1 | 2 | | ≧A+(B−A)÷9×1 |
| | 1 | | ≧A |
| 0 | 0 | REGENERATION-PROCESSING-UNNECESSARY RANGE | <A |

FIG.16

| CONDITIONS | DPF-SOOT-DEPOSITED INDICATOR AND CHARACTER DISPLAYING | DPF LAMP | REGENERATION LAMP (HIGH-TEMPERATURE LAMP) | MIL LAMP | LAMP OF THE DPF SWITCH | BUZZER | CHARACTER DISPLAYING AT THE TIME OF SWITCHING |
|---|---|---|---|---|---|---|---|
| ORDINARY | DISPLAYING WITH MANUAL SWITCHING | NONE | NONE | NONE | NONE | NONE | DPF SOOT |
| DURING AUTOMATIC REGENERATION PROCESSING | DISPLAYING WITH MANUAL SWITCHING | NONE | LIGHT-TURNING-ON | NONE | NONE | NONE | DPF SOOT |
| MANUAL REGENERATION PROCESSING REQUESTED (FORMER PERIOD) | DISPLAYING WITH AUTOMATIC SWITCHING | BLINKING SLOWLY | NONE | NONE | BLINKING SLOWLY | SLOWLY (ON(1[s]) -OFF(30[s])) | DPF MAN_L |
| MANUAL REGENERATION PROCESSING REQUESTED (LATTER PERIOD) | DISPLAYING WITH AUTOMATIC SWITCHING | BLINKING FAST | NONE | NONE | BLINKING FAST | FAST (ON(3[s]) -OFF(10[s])) | DPF MAN_H |
| DURING MANUAL REGENERATION PROCESSING | DISPLAYING WITH AUTOMATIC SWITCHING | LIGHT-TURNING-ON | LIGHT-TURNING-ON | NONE | LIGHT-TURNING-ON | NONE | DPF REGEN |
| EXCESS ACCUMULATION (SERVICE REGENERATION PROCESSING) | DISPLAYING WITH AUTOMATIC SWITCHING | NONE | NONE | LIGHT-TURNING-ON OR BLINKING | NONE | STILL FASTER (ON(3[s]) -OFF(3[s])) | ERROR CODE AND DPF ERR |
| EXCESS ACCUMULATION (DPF EXCHANGE) | DISPLAYING WITH AUTOMATIC SWITCHING | NONE | NONE | LIGHT-TURNING-ON OR BLINKING | NONE | CONTINUOUSLY | ERROR CODE AND DPF ERR |

SOOT ACCUMULATION COMPUTING AND DISPLAYING DEVICE

BACKGROUND OF THE INVENTION

Field of the Invention

The present invention relates to a soot accumulation computing and displaying device that is used for regeneration processing of a filter provided in a flow path of an exhaust gas from an internal-combustion engine.

Related Art of the Invention

A DPF (Diesel Particulate Filter) is provided in a flow path of an exhaust gas from an internal-combustion engine such as a diesel engine or the like, and the exhaust gas passes through the DPF and is discharged into the atmosphere.

Herein, the DPF is a filter, which is configured with porous ceramics or the like and collects PM (Particulate Matter) that is a minute particle such as carbon or the like that is contained in the exhaust gas.

Now, since the PM collected is accumulated in the DPF, the accumulation amount of the PM increases as the driving time of the diesel engine elapses and, if the value of the accumulation amount of the PM exceeds the limiting value, a stoppage of the DPF that is called clogging is prone to be generated.

Thereupon, before the value of the accumulation amount of the PM exceeds the limiting value and an exchange of the DPF gets necessitated, regeneration processing of the DPF is conducted by burning out at high temperature the PM accumulated.

Here, more specific descriptions are given regarding the above-mentioned regeneration processing of the DPF.

In the regeneration processing of the DPF, the PM accumulated is burned out by maintaining, throughout several tens of minutes, the temperature of 600-700 degrees that is measured by a temperature sensor, which is provided on the upstream and downstream sides of the DPF.

Additionally, "600-700 degrees" means 600-700 degrees Centigrade (the same hereinafter).

This state of high temperature is realized by additionally performing post injection, using injection controlling of the injection nozzle that injects a fuel such as a light oil or the like to the cylinder of the diesel engine.

That is to say, the post injection is performed when the fuel by main injection that contributes to the engine output power is combusted inside the cylinder and the exhaust valve is opened for the purpose of discharging the exhaust gas, which has been generated by combustion, outside the cylinder.

The injection amount of the fuel in the post injection is small compared with the injection amount of the fuel in the main injection, but the fuel due to the post injection in the form of mist that is filling the exhaust gas is affected by the oxidation catalyst due to a DOC (Diesel Oxidation Catalyst) provided in the upstream side of the DPF, heat is generated, and the state of high temperature described above is realized.

Additionally, regeneration processing of the DPF is manual or automatic regeneration processing.

If the value of the accumulation amount of the PM accumulated reaches a predetermined value, primarily, automatic regeneration processing is conducted at the time of driving on the road or driving for work in the field.

However, when the load is small, since the exhaust gas temperature does not reach 600-700 degrees even if post injection is performed, regeneration processing of the DPF is not successfully conducted, and the value of the accumulation amount of the PM increases.

Then, since excess accumulation is generated, manual regeneration processing is conducted in a state where the vehicle is allowed to stop, so that the DPF will not be damaged.

The necessity of manual regeneration processing is displayed using an alert light of the instrumental panel, or a liquid crystal displaying part capable of displaying messages.

Of course, for the purpose of encouraging manual regeneration processing, the low-idling rotation number may be maintained by forcibly suppressing main injection.

Moreover, the DOC may not be provided that allows by combustion the unburned fuel to oxidize.

For example, in a case where only the DPF is provided, the exhaust gas temperature of 600-700 degrees that is measured by a temperature sensor, which is provided on the upstream and downstream sides of the DPF, is maintained using (1) controlling of the opening/closing timing of the exhaust valve and the post fuel injection timing, (2) controlling of the opening/closing timing of the exhaust valve and the post fuel injection amount, (3) controlling of the exhaust gas temperature and the post fuel injection amount, and the like.

Of course, also in a case where the DPF is provided, if the above-mentioned controlling is used, the post fuel injection is more accurately conducted, and the post fuel injection amount becomes less.

Thereupon, for the purpose of conducting regeneration processing of a DPF at an appropriate timing, known is a technology of calculating an inferred value of the accumulation amount of the PM based on the driving state of the diesel engine (for example, see Japanese Patent Application Publication No. H11-132026 and Japanese Patent Application Publication No. 2009-91915).

SUMMARY OF THE INVENTION

However, merely calculating an inferred value of the accumulation amount of PM based on the driving state of a diesel engine has been insufficient for the purpose of conducting at an appropriate timing regeneration processing of a DPF provided in a flow path of an exhaust gas from an internal-combustion engine.

To give more specific descriptions, it is desirable to allow a vehicle to stop for several tens of minutes to conduct regeneration processing (manual regeneration) that should be surely conducted, and then the function of the vehicle, the engine output power and the like are restricted.

Accordingly, a soot accumulation computing and displaying device is helpful such that it is possible to give in advance a notification on when regeneration processing becomes necessary for which work is forced to be interrupted.

On the other hand, if regeneration processing of a DPF is conducted in a state where the soot accumulation density is large, since the combustion rate of the soot is swift, and a large amount of heat is generated, then an abnormal high-temperature state is generated in the inner part of the DPF, and the DPF is prone to corrupt.

Thereupon, for the purpose of conducting at an appropriate timing regeneration processing to always keep the DPF in a sound state, and preventing the soot accumulation density from exceeding the permissible amounts that are different according to the characteristics of the engine and/or DPF, an inferred value of the accumulation amount of the soot is calculated.

However, with regards to a technique to compute the inferred value of the accumulation amount of the soot merely based on a single computing technique, when an error of the inferred value has been generated, it is concerned that the actual accumulation amount of the soot exceeds the permissible amount.

Moreover, with regards to a technique to compute respectively the inferred values of the accumulation amount of the soot based on plural computing techniques with different viewpoints, and judge that regeneration processing is necessary when any of the inferred values exceeds the permissible amount, since the permissible amounts of the plural inferred values must be individually dealt with, the configuration of the displaying device is apt to become complicated.

After all, it has been difficult to conduct regeneration processing of a DPF at an appropriate timing.

An aspect of the present invention is, in consideration of the conventional problems described above, to furnish a soot accumulation computing and displaying device capable of conducting at a more appropriate timing regeneration processing of a filter provided in a flow path of an exhaust gas from an internal-combustion engine, such that there is no fear of underestimates of the soot accumulation of the filter.

The $1^{st}$ aspect of the present invention is a soot accumulation computing and displaying device, which is configured to perform displaying of information with regards to an accumulation amount of soot in a filter provided in a flow path of an exhaust gas from an internal-combustion engine, comprising:

a first calculating part that is configured to calculate a first inferred value of a present accumulation amount of the soot, based on a main fuel injection amount having contributed to driving of the internal-combustion engine, and a post fuel injection amount having contributed to regeneration processing of the filter, both of the fuel injection amounts being estimated to a present time from an ending time of a latest regeneration processing of the filter among regeneration processings of the filter completed in past;

a second calculating part that is configured to calculate a second inferred value of a present accumulation amount of the soot, based on a driving time of the internal-combustion engine, which is estimated to a present time from a starting time of a latest regeneration processing of the filter among regeneration processings of the filter conducted in past, and a first relation, which has been found beforehand, between the driving time of the internal-combustion engine and the accumulation amount of the soot;

a determining part that is configured to determine a maximum inferred value among the first and second inferred values; and a displaying part that is configured to perform displaying with regards to the maximum inferred value determined by the determining part.

By means of this, since the maximum inferred value among the first and second inferred values is determined, there is no fear of underestimates of the soot accumulation, and it is possible to conduct regeneration processing of a filter at a more appropriate timing.

The $2^{nd}$ aspect of the present invention is a soot accumulation computing and displaying device, which is configured to perform displaying of information with regards to an accumulation amount of soot in a filter provided in a flow path of an exhaust gas from an internal-combustion engine, comprising:

a first calculating part that is configured to calculate a first inferred value of a present accumulation amount of the soot, based on a main fuel injection amount having contributed to driving of the internal-combustion engine, and a post fuel injection amount having contributed to regeneration processing of the filter, both of the fuel injection amounts being estimated to a present time from an ending time of a latest regeneration processing of the filter among regeneration processings of the filter completed in past;

a third calculating part that is configured to calculate a third inferred value of a present accumulation amount of the soot, based on a driving time of the internal-combustion engine, which is estimated to a present time from an ending time of a latest regeneration processing of the filter among regeneration processings of the filter completed in past, and a second relation, which has been found beforehand, between the driving time of the internal-combustion engine and the accumulation amount of the soot;

a determining part that is configured to determine a maximum inferred value among the first and third inferred values; and a displaying part that is configured to perform displaying with regards to the maximum inferred value determined by the determining part.

By means of this, since the maximum inferred value among the first and third inferred values is determined, there is no fear of underestimates of the soot accumulation, and it is possible to conduct regeneration processing of a filter at a more appropriate timing.

The $3^{rd}$ aspect of the present invention is a soot accumulation computing and displaying device, which is configured to perform displaying of information with regards to an accumulation amount of soot in a filter provided in a flow path of an exhaust gas from an internal-combustion engine, comprising:

a first calculating part that is configured to calculate a first inferred value of a present accumulation amount of the soot, based on a main fuel injection amount having contributed to driving of the internal-combustion engine, and a post fuel injection amount having contributed to regeneration processing of the filter, both of the fuel injection amounts being estimated to a present time from an ending time of a latest regeneration processing of the filter among regeneration processings of the filter completed in past;

a second calculating part that is configured to calculate a second inferred value of a present accumulation amount of the soot, based on a driving time of the internal-combustion engine, which is estimated to a present time from a starting time of a latest regeneration processing of the filter among regeneration processings of the filter conducted in past, and a first relation, which has been found beforehand, between the driving time of the internal-combustion engine and the accumulation amount of the soot;

a third calculating part that is configured to calculate a third inferred value of a present accumulation amount of the soot, based on a driving time of the internal-combustion engine, which is estimated to a present time from an ending time of a latest regeneration processing of the filter among regeneration processings of the filter completed in past, and a second relation, which has been found beforehand, between the driving time of the internal-combustion engine and the accumulation amount of the soot;

a determining part that is configured to determine a maximum inferred value among the first, second and third inferred values; and a displaying part that is configured to perform displaying with regards to the maximum inferred value determined by the determining part.

By means of this, since the maximum inferred value among the first, second and third inferred values is determined, there is no fear of underestimates of the soot accumulation, and it is possible to conduct regeneration processing of a filter at a more appropriate timing.

The $4^{th}$ aspect of the present invention is a soot accumulation computing and displaying device according to any of the $1^{st}$ to $3^{rd}$ aspects of the present invention, wherein the displaying part is also utilized as a displaying part that is configured to display a cooling water temperature of the internal-combustion engine.

By means of this, the device configuration becomes simpler.

By the present invention, it is possible to furnish a soot accumulation computing and displaying device capable of conducting at a more appropriate timing regeneration processing of a filter provided in a flow path of an exhaust gas from an internal-combustion engine, such that there is no fear of underestimates of the soot accumulation of the filter.

BRIEF DESCRIPTION OF THE DRAWINGS

FIG. 7 is an illustrative drawing of the method of assigning the stoppage degree of the DPF to the instrumental panel displaying of Embodiment 1 in the present invention;

FIG. 16 is an illustrative drawing of the method of switching the instrumental panel displaying and the like of Embodiment 1 in the present invention;

DESCRIPTION OF SYMBOLS

Figure 1:
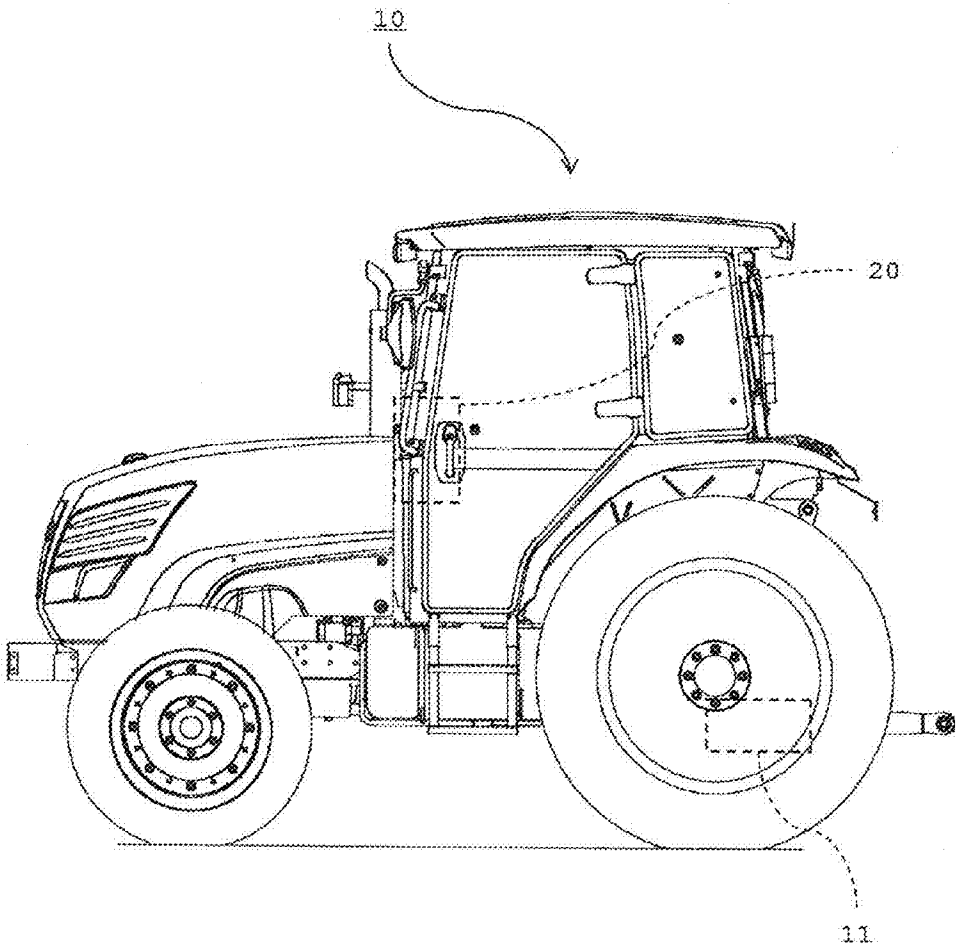
FIG. 1 is a schematic side view of the vehicle of Embodiment 1 in the present invention.

10 vehicle
11 DPF
20 soot accumulation computing and displaying device
21 first calculating part
22 second calculating part
23 third calculating part
24 replacing part

25 determining part
26 displaying part

PREFERRED EMBODIMENTS OF THE INVENTION

In the following, referring to the drawings, descriptions are given in detail regarding embodiments of the present invention and the invention related to the present invention.

Embodiment 1

Figure 2:
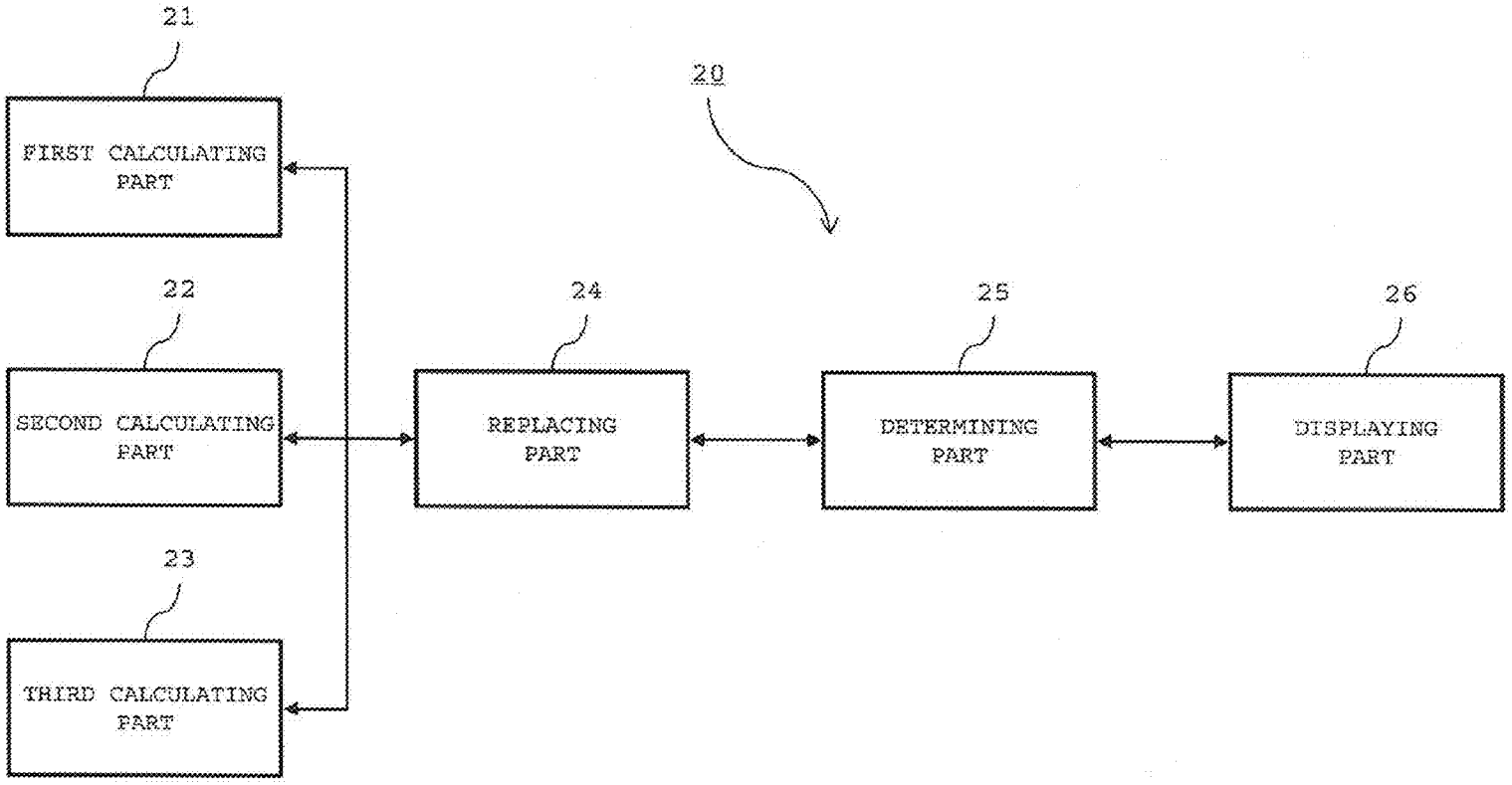
FIG. 2 is a schematic block diagram of the soot accumulation computing and displaying device of Embodiment 1 in the present invention.

In the beginning, mainly referring to FIG. 1 and FIG. 2, descriptions are given regarding the configuration and action of the soot accumulation computing and displaying device 20 of Embodiment 1.

Herein, FIG. 1 is a schematic side view of the vehicle 10 of Embodiment 1 in the present invention, and FIG. 2 is a schematic block diagram of the soot accumulation computing and displaying device 20 of Embodiment 1 in the present invention.

The vehicle 10 is an agricultural machine such as a tractor, a combine harvester or the like into which an internal-combustion engine such as a diesel engine or the like, and the DPF 11 and the soot accumulation computing and displaying device 20 are loaded.

The soot accumulation computing and displaying device 20 is a computing and displaying device that performs displaying of information with regards to the accumulation amount of soot in the DPF 11 provided in the flow path of the exhaust gas from the internal-combustion engine.

The soot accumulation computing and displaying device 20 comprises the first calculating part 21, the second calculating part 22, the third calculating part 23, the replacing part 24, the determining part 25, and the displaying part 26.

The first calculating part 21 is a means that calculates the first inferred value of the accumulation amount, based on the driving state of the internal-combustion engine.

That is to say, the first inferred value is, for example, an inferred value of the present accumulation amount of the soot that is calculated based on the main fuel injection amount having contributed to the driving of the internal-combustion engine, and the post fuel injection amount having contributed to the regeneration processing of the DPF 11, both of the fuel injection amounts being estimated to the present time from the ending time of the latest regeneration processing of the DPF 11 among the regeneration processings of the DPF 11 completed in the past.

Additionally, the main fuel injection amount having contributed to the driving of the internal-combustion engine is a fuel injection amount in order to obtain the driving force of the vehicle 10 that is necessary to driving on the road, driving for work or the like.

Moreover, a use of the first inferred value based on the relation between the fuel injection amounts and the accumulation amount of the soot is significant but, for the purpose of improving safety more, the second and third inferred values are further used.

The second calculating part 22 is a means that calculates the second inferred value of the accumulation amount, based on the internal-combustion engine driving time from the starting time point of the latest regeneration processing among the regeneration processings of the DPF 11 conducted in the past.

That is to say, the second inferred value is, for example, an inferred value of the present accumulation amount of the soot that is calculated based on the driving time of the internal-combustion engine, which is estimated to the present time from the starting time of the latest regeneration processing of the DPF 11 among the regeneration processings of the DPF 11 conducted in the past, and the first relation (to be described later), which has been found beforehand, between the driving time of the internal-combustion engine and the accumulation amount of the soot.

The third calculating part 23 is a means that calculates the third inferred value of the accumulation amount, based on the internal-combustion engine driving time from the ending time point of the latest regeneration processing among the regeneration processings of the DPF 11 completed in the past.

That is to say, the third inferred value is, for example, an inferred value of the present accumulation amount of the soot that is calculated based on the driving time of the internal-combustion engine, which is estimated to the present time from the ending time of the latest regeneration processing of the DPF 11 among the regeneration processings of the DPF 11 completed in the past, and the second relation (to be described later), which has been found beforehand, between the driving time of the internal-combustion engine and the accumulation amount of the soot.

The replacing part 24 is a means that replaces all or part of the first, second and third inferred values with corresponding accumulation degrees respectively.

The determining part 25 is a means that determines the maximum accumulation degree among all or part of the accumulation degrees.

The displaying part 26 is a means that displays the maximum accumulation degree.

The units of the first, second and third inferred values are common, and the common unit of the first to third inferred values is g/L.

Next, mainly referring to FIGS. 3-6, more specific descriptions are given regarding the action of the soot accumulation computing and displaying device 20 of the present embodiment.

Figure 3:
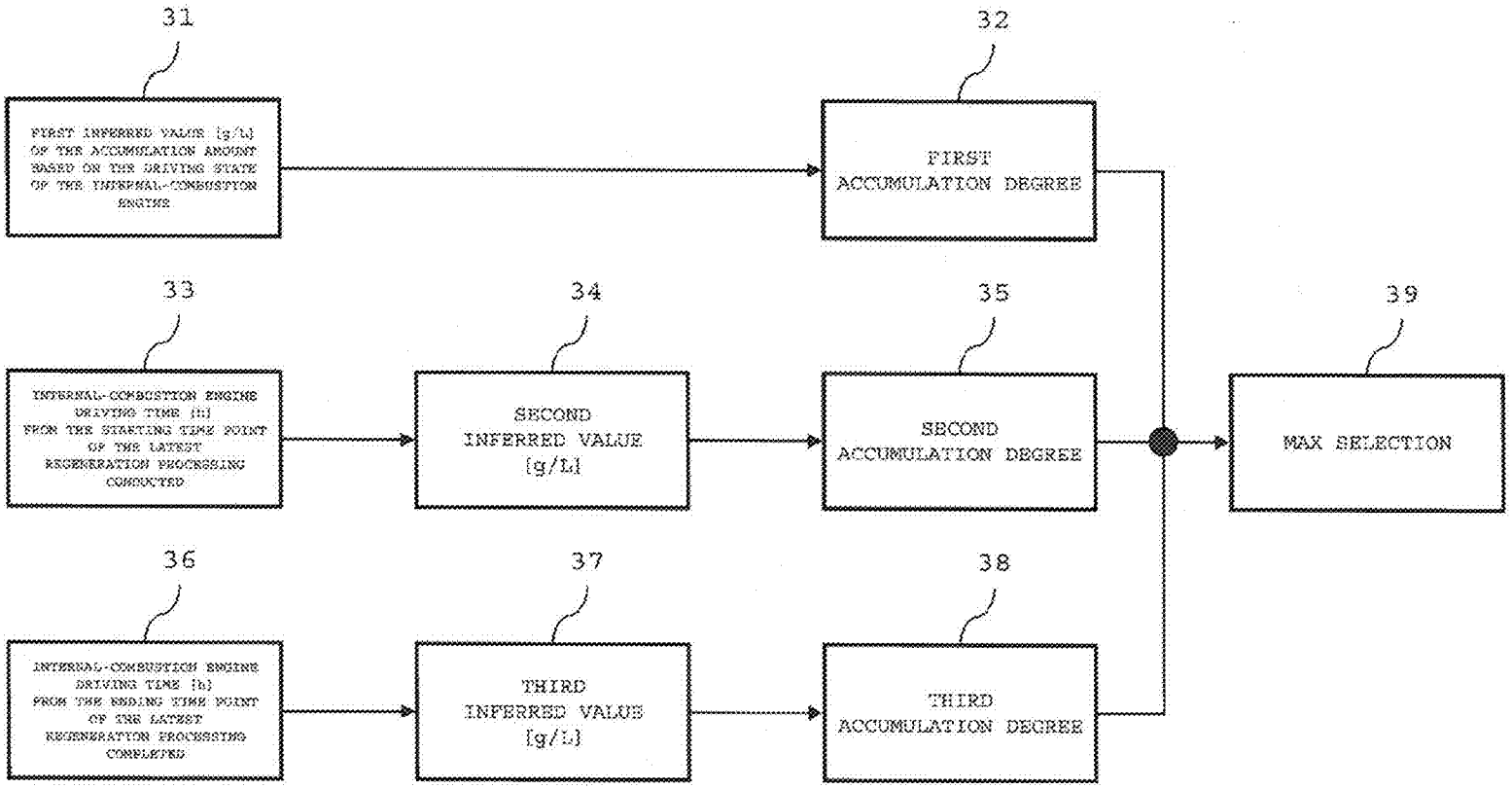
FIG. 3 is an illustrative drawing of the action of the soot accumulation computing and displaying device of Embodiment 1 in the present invention.
Figure 4:
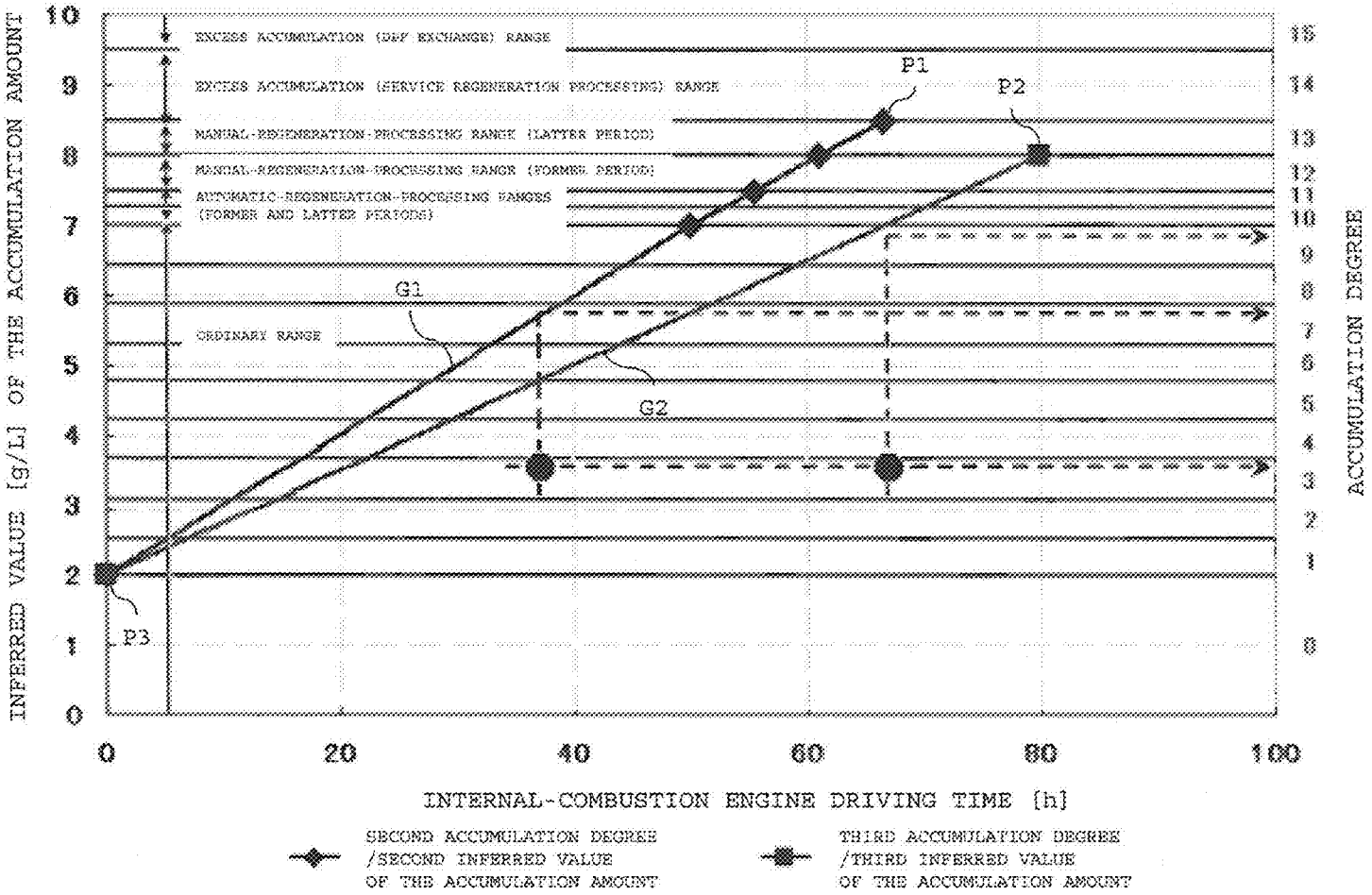
FIG. 4 is an illustrative drawing of the relation between the internal-combustion engine driving time, the inferred value of the accumulation amount, and the accumulation degree of Embodiment 1 in the present invention.
Figure 5:
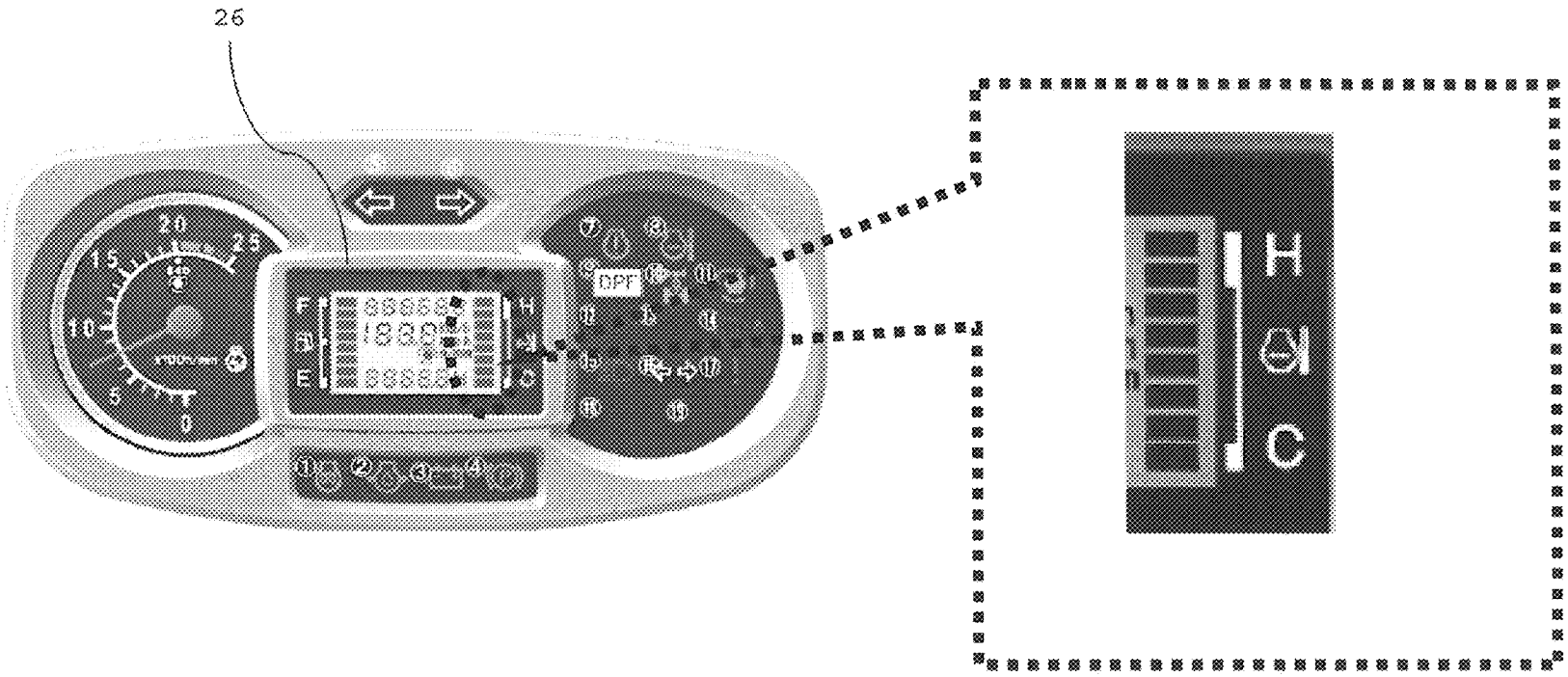
FIG. 5 is an illustrative drawing of the instrumental panel displaying of Embodiment 1 in the present invention.
Figure 6:
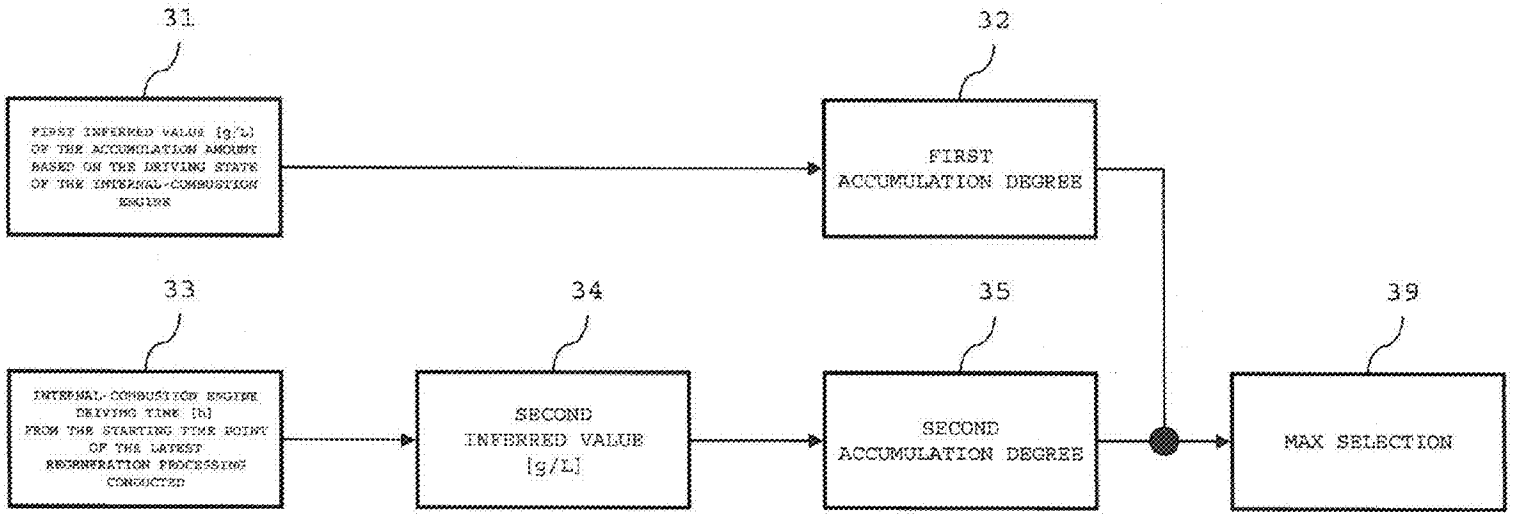
FIG. 6 is an illustrative drawing of the action of the soot accumulation computing and displaying device of Embodiment 1 in the present invention, which is performed when manual regeneration processing that corresponds to the instruction from the user is being conducted.

Herein, FIG. 3 is an illustrative drawing of the action of the soot accumulation computing and displaying device 20 of Embodiment 1 in the present invention, FIG. 4 is an illustrative drawing of the relation between the internal-combustion engine driving time, the inferred value of the accumulation amount, and the accumulation degree of Embodiment 1 in the present invention, FIG. 5 is an illustrative drawing of the instrumental panel displaying of Embodiment 1 in the present invention, and FIG. 6 is an illustrative drawing of the action of the soot accumulation computing and displaying device 20 of Embodiment 1 in the present invention, which is performed when manual regeneration processing that corresponds to the instruction from the user is being conducted.

As shown in FIG. 3, the first inferred value [g/L] 31 of the accumulation amount based on the driving state of the internal-combustion engine is obtained by the first calculating part 21 (see FIG. 2).

Further, that first inferred value 31 of the accumulation amount is converted into the first accumulation degree 32 (non-dimensionalization) by the replacing part 24 (see FIG. 2).

Herein, the accumulation degree is an index that does not depend on the species or characteristics of the internal-combustion engine or DPF, and shows the commonized extent of accumulation.

Next, the second inferred value [g/L] 34 of the accumulation amount is, corresponding to the internal-combustion engine driving time [h] 33 from the starting time point of the latest regeneration processing conducted, obtained by the second calculating part 22 (see FIG. 2).

Further, that second inferred value 34 of the accumulation amount is converted into the second accumulation degree 35 (non-dimensionalization) by the replacing part 24 (see FIG. 2).

Next, the third inferred value [g/L] 37 of the accumulation amount is, corresponding to the internal-combustion engine driving time [h] 36 from the ending time point of the latest regeneration processing completed, obtained by the third calculating part 23 (see FIG. 2).

Further, that third inferred value 37 of the accumulation amount is converted into the third accumulation degree 38 (non-dimensionalization) by the replacing part 24 (see FIG. 2).

And, the MAX selection 39 that determines the maximum accumulation degree among the first to third accumulation degrees 32, 35 and 38 is performed by the determining part 25 (see FIG. 2).

Next, using FIG. 4, further specific descriptions are given.

Herein, in FIG. 4, the horizontal axis shows the internal-combustion engine driving time [h], the vertical axis on the left side shows the inferred value [g/L] of the accumulation amount, and the vertical axis on the right side shows the accumulation degree. And, the straight line on the upper side shows the second accumulation degree 35/second inferred value 34 of the accumulation amount, and the straight line on the lower side shows the third accumulation degree 38/third inferred value 37 of the accumulation amount.

That is to say, when the first inferred value 31 of the accumulation amount is 3.5 [g/L], the first accumulation degree 32 is 3, when the internal-combustion engine driving time 33 from the starting time point of the latest regeneration processing conducted is 37 [h], the second inferred value 34 of the accumulation amount is about 5.8 [g/L], and the second accumulation degree 35 is 7, when the internal-combustion engine driving time 36 from the ending time point of the latest regeneration processing completed is 67 [h], the third inferred value 37 of the accumulation amount is about 6.9 [g/L], and the third accumulation degree 38 is 9 and, accordingly the maximum accumulation degree is 9.

The relation that is defined with the graph G1 represented by the straight line on the upper side is a specific example of the above-mentioned first relation, and the relation that is defined with the graph G2 represented by the straight line on the lower side is a specific example of the above-mentioned second relation.

Since regeneration processing conducted is not necessarily completed, to avoid underestimates of the second inferred value 34 of the accumulation amount, it is desirable that the value of the slope of the graph G1 be slightly larger than the value of the slope of the graph G2.

Of course, the second inferred value 34 of the accumulation amount might be larger than the third inferred value 37 of the accumulation amount, and the third inferred value 37 of the accumulation amount might be larger than the second inferred value 34 of the accumulation amount.

For example, in a case where the regeneration processing is being conducted or has been interrupted, the third inferred value 37 of the accumulation amount is often larger than the second inferred value 34 of the accumulation amount.

It is because, in a case like this, the ending time point of the latest regeneration processing completed is often considerably earlier than the starting time point of the latest regeneration processing conducted.

Additionally, it is desirable that the value of the vertical axis corresponding to the right endpoint P1 of the graph G1, and the value of the vertical axis corresponding to the right endpoint P2 of the graph G2 be determined based on the upper-limit value of the accumulation amount that could be generated.

The above-mentioned upper-limit value is, for example, a value based on experiments repeatedly performed, such that a larger accumulation amount could not be generated in any driving state of the internal-combustion engine.

Moreover, since the accumulation amount does not completely become zero even if the regeneration processing is completed, it is desirable that the value of the vertical axis corresponding to the left endpoint P3 of the graphs G1 and G2 not be zero (>0).

Of course, these values that are experimentally or theoretically obtained may be different according to the species or characteristics of the internal-combustion engine (an engine displacement and the like) or DPF.

Additionally, regarding the conversion like the above from the inferred value into the accumulation degree, further descriptions are given in the below-mentioned "Methods of Assigning the Stoppage Degree of the DPF to the Instrumental Panel Displaying."

As a consequence, the maximum accumulation degree is displayed (see FIG. 5) by the displaying part 26 (see FIG. 2) with a bar or the like using CAN (Controller Area Network) message sending or the like.

Since the maximum accumulation degree among the first to third accumulation degrees is determined, there is no fear of underestimates of the soot accumulation, and it is possible to surely conduct necessary regeneration processing at an appropriate timing.

Hereupon, when manual regeneration processing that corresponds to the instruction from the user is being conducted, another processing is performed. That is to say, as shown in FIG. 6, the replacing part 24 replaces the first and second inferred values with corresponding accumulation degrees respectively. Next, the determining part 25 determines the maximum accumulation degree among the accumulation degrees corresponding to the first and second inferred values.

Additionally, it does not matter if the replacing part 24 replaces the first, second and third inferred values with corresponding accumulation degrees, respectively, even when manual regeneration processing that corresponds to the instruction from the user is being conducted. Then, the determining part 25 would ignore the third accumulation degree.

Next, more specific descriptions are given chiefly citing variants regarding the replacing part 24 and displaying part 26 of the soot accumulation computing and displaying device 20 of the present embodiment.

A. Methods of Assigning the Stoppage Degree of the DPF to the Instrumental Panel Displaying.

Mainly referring to FIG. 7, descriptions are given regarding the method of assigning the stoppage degree of the DPF 11 to the instrumental panel displaying.

Herein, FIG. 7 is an illustrative drawing of the method of assigning the stoppage degree of the DPF 11 to the instrumental panel displaying of Embodiment 1 in the present invention.

That is to say, the threshold values are defined using the parameters A-F [g/L] that depend on the characteristics or the like of the DPF 11 and internal-combustion engine, and the stoppage degree of the DPF 11 is displayed on the instrumental panel with a bar or numerical value using a meter gauge to which indications are assigned that correspond to the non-dimensional accumulation degrees 0-15.

Of course, the above-mentioned method is based on the principle that the ratio of the increment of the accumulation amount to the increment of the internal-combustion engine driving time is roughly constant, and a specific value of the ratio is experimentally or theoretically obtained.

Regarding the regeneration processing controlling division that yields the indexes commonized to the DPFs and internal-combustion engines of many species, with which a use for judgment on the stoppage degree of the DPF 11 is possible, the details are as follows.

The regeneration-processing-unnecessary range is a range such that regeneration processing of the DPF 11 is not necessitated at all, corresponding to the accumulation degree 0 that is defined using the numerical range in which the inferred value of the accumulation amount is less than the threshold value A.

Herein, the parameter A is a parameter that corresponds to the accumulation amount at the time point of the regeneration processing completion.

Additionally, when the accumulation degree is 0, the indication 0 without accumulation displaying is assigned to the meter gauge.

The ordinary range is a range such that regeneration processing of the DPF 11 is not particularly necessitated, corresponding to the accumulation degree d ($1 \leq d \leq 9$) that is defined using the numerical range in which the inferred value of the accumulation amount is equal to or greater than the threshold value $$A+(d-1)\times(B-A)/9$$

and is less than the threshold value $$A+d\times(B-A)/9.$$

Herein, the parameter B(≥A) is a parameter that coincides with the lower-side threshold value of the numerical range that is used for the purpose of defining the accumulation degree 10 to which the automatic-regeneration-processing range (former period) that is described later corresponds.

Additionally, when the accumulation degree is 1 or 2, the indication 1 is assigned to the meter gauge by grouping. Moreover, when the accumulation degree is 3 or 4, the indication 2 is assigned to the meter gauge by grouping. Moreover, when the accumulation degree is 5 or 6, the indication 3 is assigned to the meter gauge by grouping. Moreover, when the accumulation degree is 7-9, the indication 4 is assigned to the meter gauge by grouping.

The automatic-regeneration-processing range (former period) is a range such that pressing down of the manual-regeneration-processing button by the user is not necessitated, and is a range corresponding to the accumulation degree 10 to conduct automatic regeneration processing of the DPF 11, which is defined using the numerical range in which the inferred value of the accumulation amount is equal to or greater than the threshold value B and is less than the threshold value (B+C)/2.

Herein, the parameter C (≥B) is a parameter that coincides with the lower-side threshold value of the numerical range that is used for the purpose of defining the accumulation degree 12 to which the manual-regeneration-processing range (former period) that is described later corresponds.

Additionally, when the accumulation degree is 10, the indication 5 is assigned to the meter gauge.

The automatic-regeneration-processing range (latter period) is a range corresponding to the accumulation degree 11 to conduct automatic regeneration processing of the DPF 11, which is defined using the numerical range in which the inferred value of the accumulation amount is equal to or greater than the threshold value (B+C)/2 and is less than the threshold value C.

Additionally, when the accumulation degree is 11, the indication 6 is assigned to the meter gauge.

The manual-regeneration-processing range (former period) is a range such that pressing down of the manual-regeneration-processing button by the user is necessitated, and is a range corresponding to the accumulation degree 12 to conduct manual regeneration processing of the DPF 11, which is defined using the numerical range in which the inferred value of the accumulation amount is equal to or greater than the threshold value C and is less than the threshold value D.

Herein, the parameter D (≥C) is a parameter that coincides with the lower-side threshold value of the numerical range that is used for the purpose of defining the accumulation degree 13 to which the manual-regeneration-processing range (latter period) that is described later corresponds.

Additionally, when the accumulation degree is 12, the indication 7 is assigned to the meter gauge.

The manual-regeneration-processing range (latter period) is a range corresponding to the accumulation degree 13 to conduct manual regeneration processing of the DPF 11, which is defined using the numerical range in which the inferred value of the accumulation amount is equal to or greater than the threshold value D and is less than the threshold value E.

Herein, the parameter E (≥D) is a parameter that coincides with the lower-side threshold value of the numerical range that is used for the purpose of defining the accumulation degree 14 to which the excess accumulation (service regeneration processing) range that is described later corresponds.

Additionally, when the accumulation degree is 13, the indication 8 is assigned to the meter gauge.

The excess accumulation (service regeneration processing) range is a range capable of regeneration processing by a dealer that utilizes an engine service tool with a mechanism incorporated such that it is possible to avoid abnormal combustion, and is a range corresponding to the accumulation degree 14 that is defined using the numerical range in which the inferred value of the accumulation amount is equal to or greater than the threshold value E and is less than the threshold value F.

In the excess accumulation (service regeneration processing) range, manual regeneration is being prohibited since, if manual regeneration by the user is conducted, there is a possibility that abnormal combustion of soot is generated.

Herein, the parameter F (≥E) is a parameter that coincides with the lower-side threshold value of the numerical range that is used for the purpose of defining the accumulation degree 15 to which the excess accumulation (DPF exchange) range that is described later corresponds.

Additionally, when the accumulation degree is 14, the indication 8 (Flash_Slow) is assigned to the meter gauge.

The excess accumulation (DPF exchange) range is a range such that soot removal processing by disassembly or exchange of the DPF 11 from the engine is necessary, and is a range corresponding to the accumulation degree 15 that is defined using the numerical range in which the inferred value of the accumulation amount is equal to or greater than the threshold value F.

In the excess accumulation (DPF exchange) range, regeneration processing by post injection in a state where the DPF 11 is loaded into the engine is being completely prohibited since, if regeneration processing by a dealer is conducted, there is a possibility that abnormal combustion of soot is generated.

Additionally, when the accumulation degree is 15, the indication 8 (Flash_Fast) is assigned to the meter gauge.

B. Methods of More Appropriately Allowing the User to Recognize that Manual Regeneration Processing of the DPF is being Conducted.

Mainly referring to FIGS. 8(A)-8(D) and FIG. 9, descriptions are given regarding the methods of more appropriately allowing the user to recognize that manual regeneration processing of the DPF 11 is being conducted.

Figure 8A:
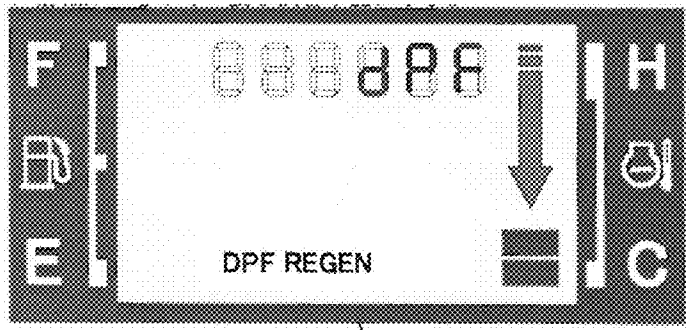
FIG. 8(A) is an illustrative drawing (I) of the instrumental panel displaying at the time of manual regeneration processing of the DPF of Embodiment 1 in the present invention.
Figure 8B:
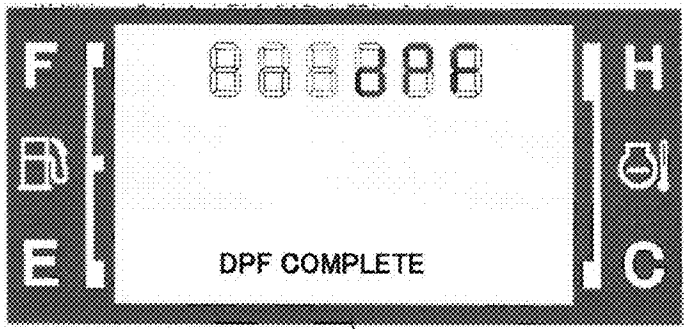
FIG. 8(B) is an illustrative drawing (II) of the instrumental panel displaying at the time of manual regeneration processing of the DPF of Embodiment 1 in the present invention.
Figure 8C:
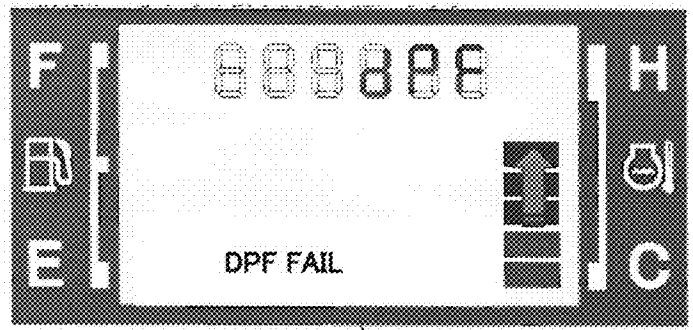
FIG. 8(C) is an illustrative drawing (III) of the instrumental panel displaying at the time of manual regeneration processing of the DPF of Embodiment 1 in the present invention.
Figure 8D:
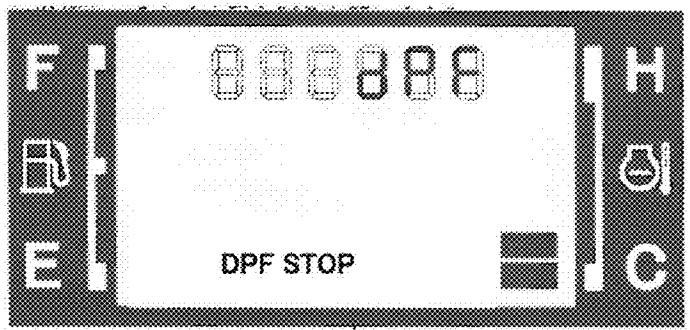
FIG. 8(D) is an illustrative drawing (IV) of the instrumental panel displaying at the time of manual regeneration processing of the DPF of Embodiment 1 in the present invention.
Figure 9:
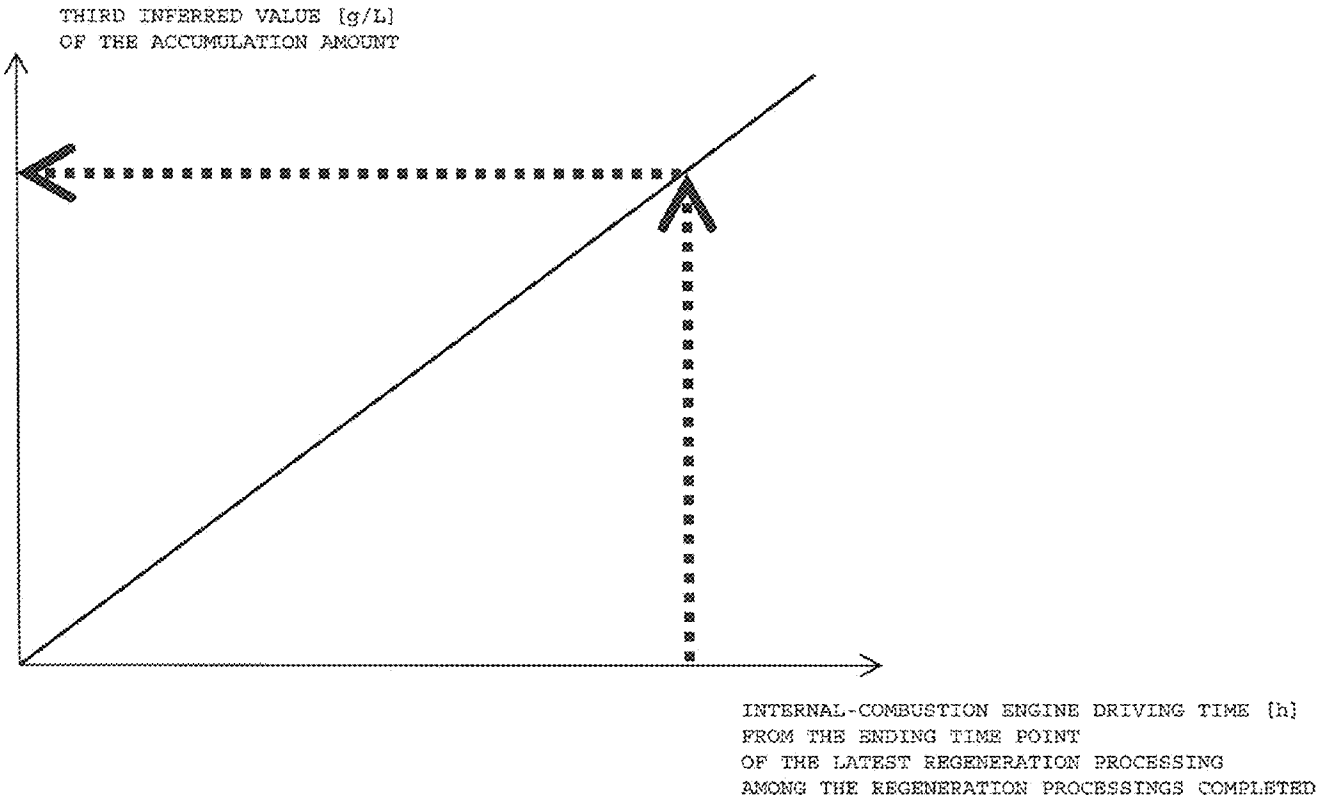
FIG. 9 is an illustrative drawing of the relation of Embodiment 1 in the present invention, between the internal-combustion engine driving time from the ending time point of the latest regeneration processing among the regeneration processings completed, and the third inferred value of the accumulation amount.

Herein, FIGS. 8(A)-8(D) are illustrative drawings (I-IV) of the instrumental panel displaying at the time of manual regeneration processing of the DPF 11 of Embodiment 1 in the present invention, and FIG. 9 is an illustrative drawing of the relation of Embodiment 1 in the present invention, between the internal-combustion engine driving time from the ending time point of the latest regeneration processing among the regeneration processings completed, and the third inferred value of the accumulation amount.

That is to say, as has been described above, when manual regeneration processing that corresponds to the instruction from the user is being conducted, the determining part 25 determines the maximum accumulation degree among the accumulation degrees corresponding to the first and second inferred values (see FIG. 6).

When, except for the third inferred value that is not reset and keeps a constant value until the manual regeneration processing is completed, only the first and second inferred values are used that gradually decrease to zero as the manual regeneration processing progresses, the maximum accumulation degree among the accumulation degrees corresponding to the first and second inferred values gradually decreases to zero as the manual regeneration processing progresses.

Therefore, it is possible to avoid a phenomenon, which could occur when the third inferred value is also considered for accumulation degree calculation of maximum value, that the maximum accumulation degree does not decrease notwithstanding that the manual regeneration processing smoothly progresses.

And, it is possible for the user to feel, watching the instrumental panel displaying, that the regeneration processing is being conducted without fail.

More specifically, displaying is performed on the instrumental panel with a bar or numerical value using a meter gauge to which the indication is assigned that decreases corresponding to the accumulation degree, and a character string such as DPF REGEN or the like is displayed (see FIG. 8(A)).

And, if the manual regeneration processing of the DPF 11 is completed, a character string such as DPF COMPLETE or the like is displayed throughout 3 seconds or so (see FIG. 8(B)).

Hereupon, ideally manual regeneration processing of the DPF 11 must be completed but, since about several tens of minutes is necessary to complete manual regeneration processing in a state where the vehicle 10 is stopping, a user might allow the manual regeneration processing to be interrupted who wants to preferentially perform his work.

Of course, for other reasons such as a user operation, an error or the like, manual regeneration processing of the DPF 11 might be interrupted.

Thereupon, when manual regeneration processing of the DPF 11 has been interrupted, the third inferred value may again get used, so all of the first to third inferred values are replaced with corresponding accumulation degrees respectively, and the maximum accumulation degree among all of the accumulation degrees corresponding to the first to third inferred values is newly determined (see FIG. 3).

More specifically, the third inferred value of the accumulation amount is immediately calculated based on the internal-combustion engine driving time from the ending time point of the latest regeneration processing among the regeneration processings of the DPF 11 completed (see FIG. 9), (1) if the maximum accumulation degree newly determined using the third inferred value is larger than the maximum accumulation degree determined not using the third inferred value, a character string such as DPF FAIL or the like is displayed throughout 3 seconds or so along with a new larger meter gauge indication (see FIG. 8(C)), and (2) otherwise, a character string such as DPF STOP or the like is displayed throughout 3 seconds or so along with the meter gauge indication as it was (see FIG. 8(D)).

C. Methods of Giving to the Outside of the Vehicle a Notification that Manual Regeneration Processing of the DPF is being Conducted.

Mainly referring to FIG. 10, FIGS. 11(A)-11(C) and FIG. 12, descriptions are given regarding the methods of giving to the outside of the vehicle 10 a notification that manual regeneration processing of the DPF 11 is being conducted.

Figure 10:
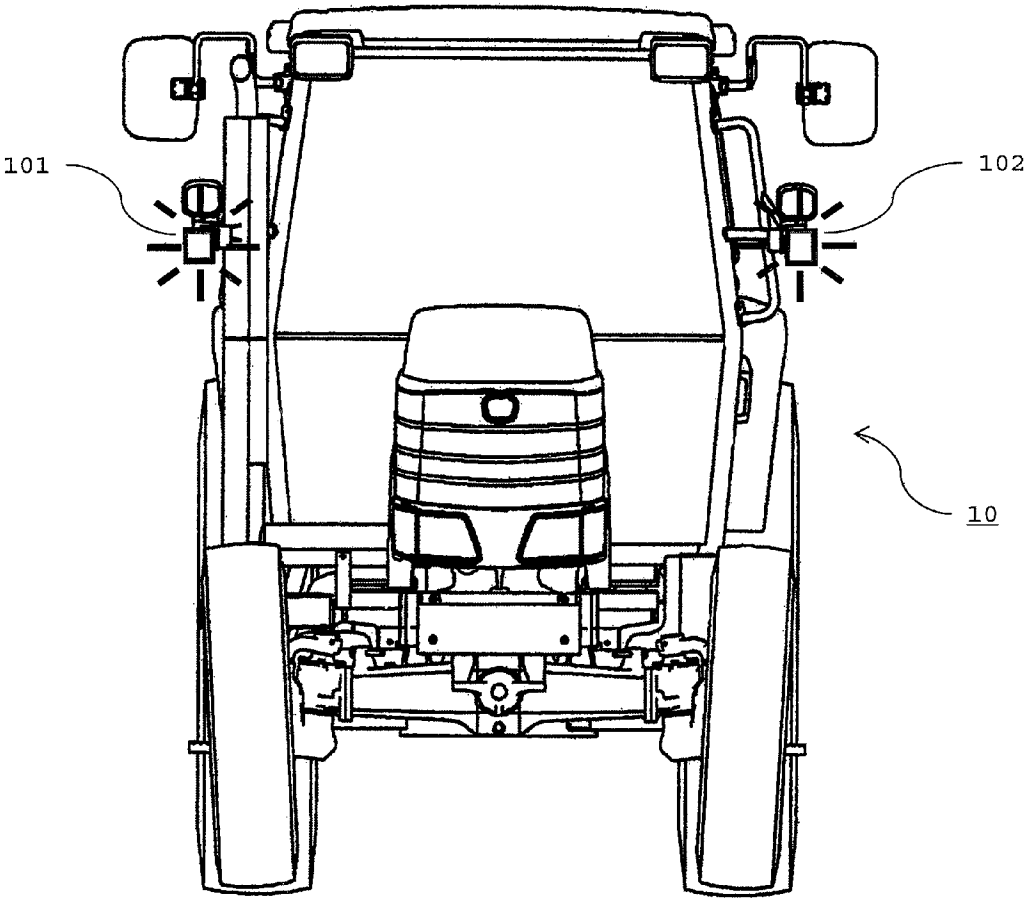
FIG. 10 is a schematic rear view of the vehicle of Embodiment 1 in the present invention into which the dedicated lamps are loaded.
Figure 11A:
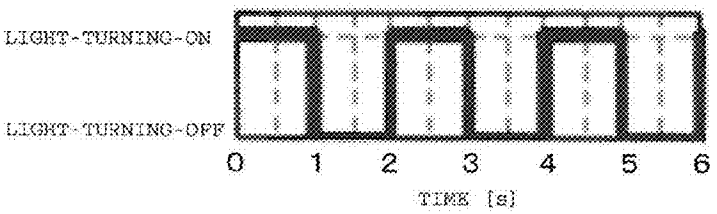
FIG. 11(A) is an illustrative drawing (I) of the pattern of the blinking cycle of the dedicated lamps of Embodiment 1 in the present invention.
Figure 11B:
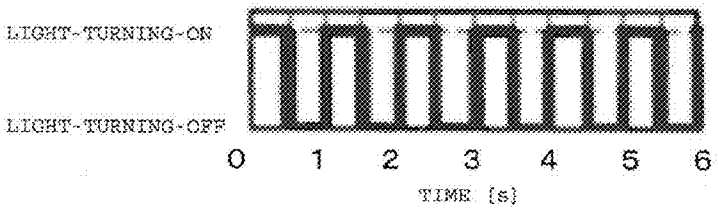
FIG. 11(B) is an illustrative drawing (II) of the pattern of the blinking cycle of the dedicated lamps of Embodiment 1 in the present invention.
Figure 11C:
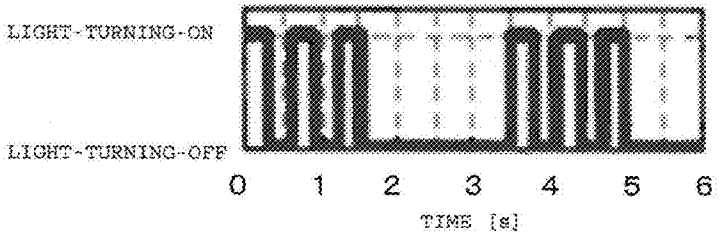
FIG. 11(C) is an illustrative drawing (III) of the pattern of the blinking cycle of the dedicated lamps of Embodiment 1 in the present invention.
Figure 12:
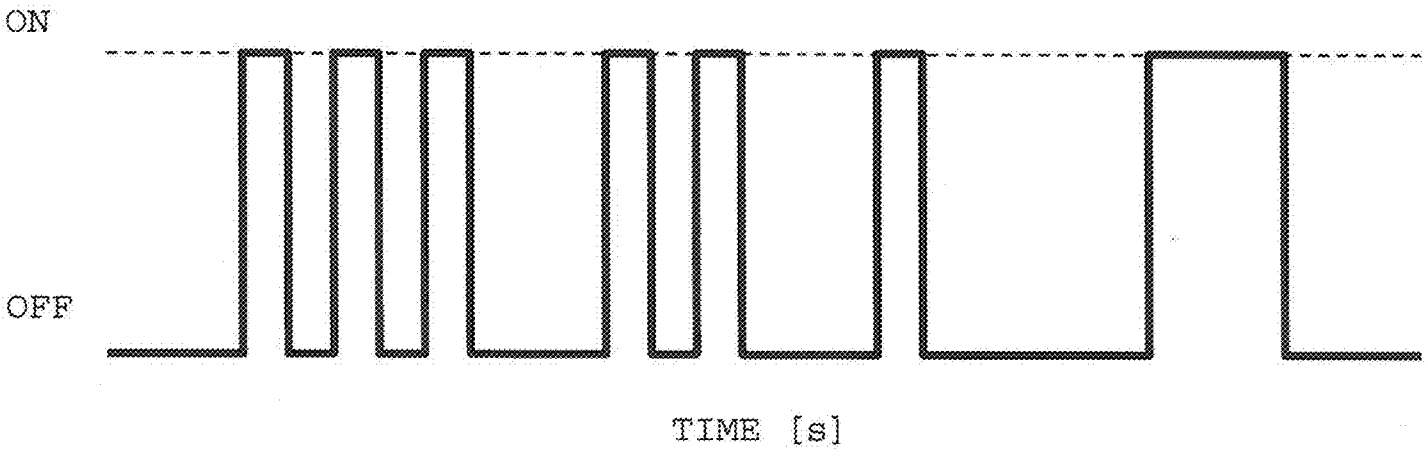
FIG. 12 is an illustrative drawing of the pattern of the rumbling cycle of the sound notification system of Embodiment 1 in the present invention.

Herein, FIG. 10 is a schematic rear view of the vehicle 10 of Embodiment 1 in the present invention into which the dedicated lamps 101 and 102 are loaded, FIGS. 11(A)-11(C) are illustrative drawings (I-III) of the patterns of the blinking cycle of the dedicated lamps 101 and 102 of Embodiment 1 in the present invention, and FIG. 12 is an illustrative drawing of the pattern of the rumbling cycle of the sound notification system of Embodiment 1 in the present invention.

Since manual regeneration processing is conducted in a state where the vehicle 10 is stopping, a user is often giving care to the remaining time of the manual regeneration processing at a place apart from the vehicle 10 during the manual regeneration processing.

However, for example, if the rotation number of the internal-combustion engine at the time of manual regeneration processing is the same as the rotation number at the ordinary low idling, it is occasionally impossible for the user outside the vehicle 10 to recognize even that manual regeneration processing is being conducted.

Further, if other people who are in the surroundings of the vehicle 10 are not recognizing that manual regeneration processing is being conducted, danger is prone to be generated.

Thereupon, using the dedicated lamps 101 and 102, a notification that manual regeneration processing is being conducted may be given to the outside of the vehicle 10 along with its remaining time (see FIG. 10).

Of course, a lamp that is provided for another purpose may be utilized as the dedicated lamps 101 and 102.

More specifically, (1) when manual regeneration processing has been started corresponding to a request from the ECU (Engine Control Unit) or the like, is used a pattern of the blinking cycle such that light-turning-on of 1.0 seconds and light-turning-off of 1.0 seconds are alternately performed (see FIG. 11(A)), (2) when the remaining time is within 10 minutes, is used a pattern of the blinking cycle such that light-turning-on of 0.5 seconds and light-turning-off of 0.5 seconds are alternately performed (see FIG. 11(B)), and (3) when the remaining time is within 3 minutes, is used a pattern of the blinking cycle such that light-turning-off of 2.0 seconds is performed after light-turning-on of 0.3 seconds and light-turning-off of 0.3 seconds have been alternately repeated three times (see FIG. 11(C)).

Alternatively, using a sound notification system, a notification that manual regeneration processing is being conducted may be given to the outside of the vehicle 10 along with its remaining time.

More specifically, (1) when the indication of the meter gauge that decreases corresponding to the accumulation degree is 1-3, is used a pattern of the rumbling cycle such that rumbling by on/off switching is correspondingly performed 1-3 times, and (2) when manual regeneration processing has been completed, is used a pattern of the rumbling cycle such that rumbling is persistently performed (see FIG. 12).

Of course, a switch to set whether the above-mentioned sound notification system is enabled may be provided.

D. Methods of More Surely Allowing the User to Recognize that Regeneration Processing of the DPF is Being Conducted.

Figure 13A:
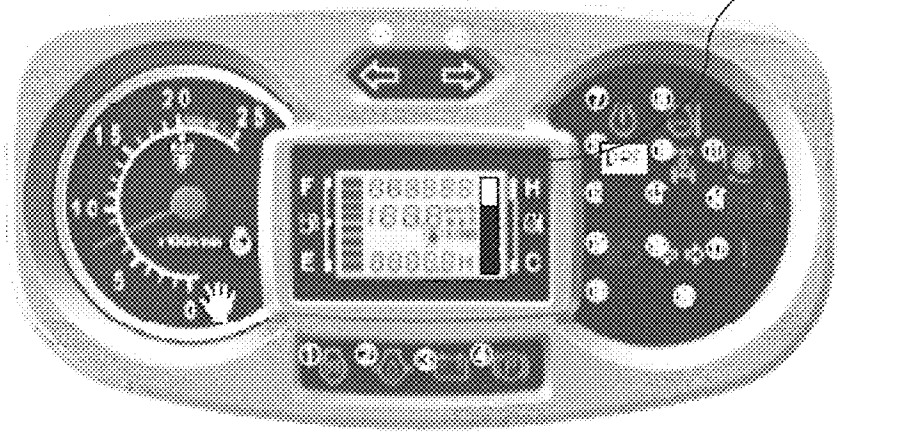
FIG. 13(A) is an illustrative drawing of the instrumental panel displaying at the time of ordinary driving of Embodiment 1 in the present invention.
Figure 13B:
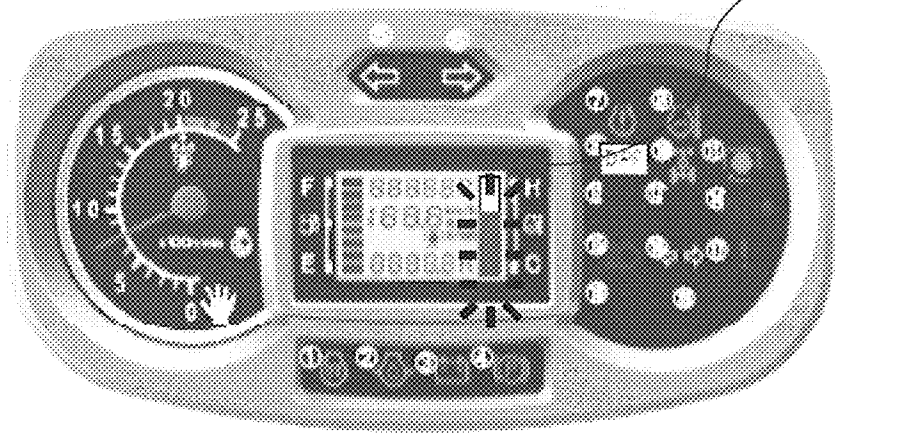
FIG. 13(B) is an illustrative drawing of the instrumental panel displaying at the time of regeneration processing of the DPF of Embodiment 1 in the present invention.

Mainly referring to FIGS. 13(A) and 13(B), descriptions are given regarding the method of more surely allowing the user to recognize that regeneration processing of the DPF 11 is being conducted.

Herein, FIG. 13(A) is an illustrative drawing of the instrumental panel displaying at the time of ordinary driving of Embodiment 1 in the present invention, and FIG. 13(B) is an illustrative drawing of the instrumental panel displaying at the time of regeneration processing of the DPF 11 of Embodiment 1 in the present invention.

Since automatic regeneration processing of the DPF does not necessitate an operation by a user like pressing down of the manual-regeneration-processing button, it is occasionally impossible for the user to recognize that automatic regeneration processing of the DPF is being conducted.

However, if combustibles and the like exist around the vehicle 10 at the time of automatic regeneration processing of the DPF, danger is prone to be generated.

Thereupon, since it is highly possible that an alert of regeneration processing only by an action lamp for example gets overlooked, in the instrumental panel of an AT (Automatic Transmission) machine for export into which an engine with a DPF conforming to regulations such as Tier4 and the like is loaded, the meter gauge may be allowed to blink with good visibility at the time of regeneration processing of the DPF 11 (see FIG. 13(B)).

Of course, if the regeneration processing of the DPF 11 is completed, the blinking is reset (see FIG. 13(A)).

E. Methods of Switching the Instrumental Panel Displaying.

Mainly referring to FIGS. 14(A) and 14(B), FIG. 15 and FIG. 16, descriptions are given regarding the method of switching the instrumental panel displaying.

Figure 14A:
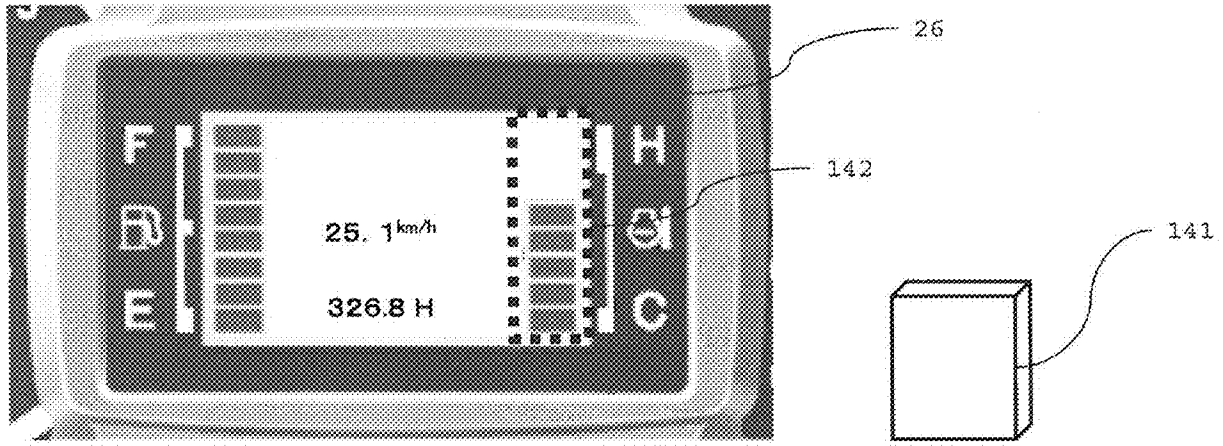
FIG. 14(A) is an illustrative drawing of the instrumental panel displaying at the time of water temperature displaying of Embodiment 1 in the present invention.
Figure 14B:
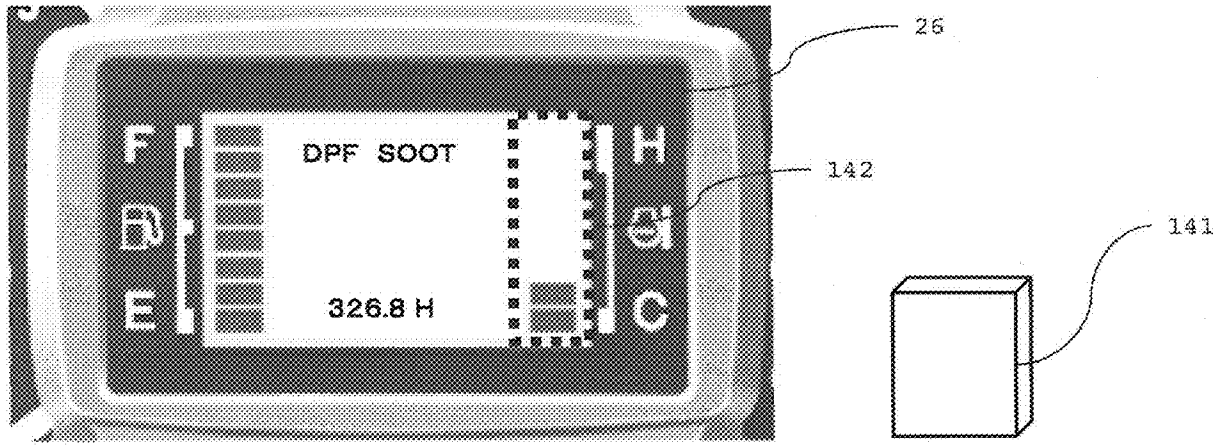
FIG. 14(B) is an illustrative drawing of the instrumental panel displaying at the time of DPF-soot-accumulated displaying of Embodiment 1 in the present invention.
Figure 15:
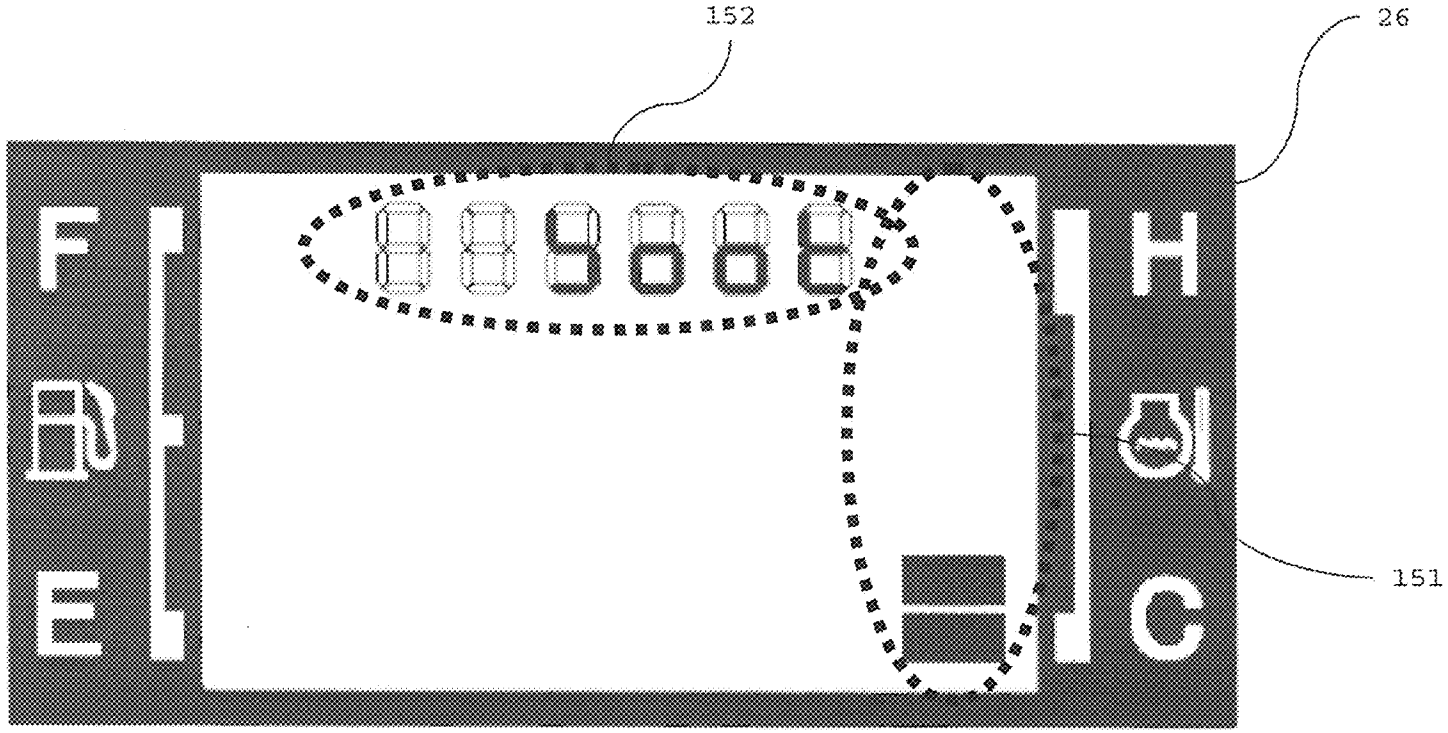
FIG. 15 is an illustrative drawing of the instrumental panel displaying of Embodiment 1 in the present invention that uses the DPF-soot-accumulated indicator displaying and the DPF maintenance information displaying.

Herein, FIG. 14(A) is an illustrative drawing of the instrumental panel displaying at the time of water temperature displaying of Embodiment 1 in the present invention, FIG. 14(B) is an illustrative drawing of the instrumental panel displaying at the time of DPF-soot-accumulated displaying of Embodiment 1 in the present invention, FIG. 15 is an illustrative drawing of the instrumental panel displaying of Embodiment 1 in the present invention that uses the DPF-soot-accumulated indicator displaying 151 and the DPF maintenance information displaying 152, and FIG. 16 is an illustrative drawing of the method of switching the instrumental panel displaying and the like of Embodiment 1 in the present invention.

In the instrumental panel must be basically always displayed the information with regards to the velocity and fuel amount of the vehicle 10, the PTO (Power Take Off), the water temperature, the work time and the like, and the displaying area of a limited space must be simplified as much as possible in order that information with regards to the DPF soot accumulated should be effectively displayed.

Thereupon, in the instrumental panel conforming to the regulations up to Tier3, provided that a switching operation by the displaying switching button 141 has been done, the DPF-soot-accumulated displaying is performed with a bar, characters or a numerical value also using the meter gauge 142 for water temperature displaying (see FIG. 14(B)), and (1) ordinarily the water temperature displaying would be again performed after about 5 seconds (see FIG. 14(A)) but, (2) for example, when manual regeneration processing is being conducted, if there is no abnormality of the water temperature, the DPF-soot-accumulated displaying may be continually performed.

More specifically, (1) when a user operation to allow manual regeneration processing to be conducted is not particularly necessary, if a switching operation by the displaying switching button 141 is not done, the DPF-soot-accumulated indicator displaying 151, and the DPF maintenance information displaying 152 such that a character string such as SOOT, DPF SOOT or the like is, while blinking, displayed, which uses a seven-segment LED (Light Emitting Diode), are not performed, and (2) when some user operation is necessary, for the purpose of clearly alerting the user to it, a buzzer is allowed to rumble while the DPF-soot-accumulated indicator displaying 151 and the DPF maintenance information displaying 152 are autonomously performed (see FIG. 15).

Regarding the specific example that is shown in FIG. 7, the details are as follows.

That is to say, it is deemed that a user operation is not particularly necessary when the accumulation degree is 0-11, and that some user operation is necessary when the accumulation degree is 12-15.

Thereupon, the buzzer is turned off when the accumulation degree is 0-11, and the buzzer is turned off during manual regeneration processing but is turned on otherwise using the cycle that is allowed to change corresponding to the accumulation degree when the accumulation degree is 12-15.

Additionally, when the accumulation degree is 0-11, the seven-segment displaying is SOOT, or DPF SOOT. Moreover, when the accumulation degree is 12, the seven-segment displaying is DPF REGEN during manual regeneration processing and is DPF_MAN_L otherwise. Moreover, when the accumulation degree is 13, the seven-segment displaying is REGEN during manual regeneration processing and is DPF_MAN_H otherwise. Moreover, when the accumulation degree is 14 or 15, the seven-segment displaying is DPF_ERR.

Still more specifically, corresponding to various conditions, the states of the DPF-soot-accumulated indicator and character displaying, the DPF lamp, the regeneration lamp (high-temperature lamp), the MIL (Malfunction Indicator Light) lamp, the lamp of the DPF switch, the buzzer and the character displaying at the time of switching may be allowed to change, so (1) when the condition is "ordinary (including the time when regeneration processing is not necessary at all)" or "during automatic regeneration processing" such that a user operation is not particularly necessary, if a manual switching such as a switching operation or the like is not done, displaying switching is not performed, and (2) when the condition is "manual regeneration processing requested (former period and latter period)," "during manual regeneration processing," "excess accumulation (service regeneration processing)" or "excess accumulation (DPF exchange)" such that some user operation is necessary, displaying switching is autonomously performed with automatic switching (see FIG. 16).

Of course, when a breakdown in the vehicle and/or engine or the like has been generated during the automatic displaying switching conducted, the details of the breakdown that has been generated may be preferentially displayed.

F. Methods of Adding a Dedicated Liquid Crystal Panel that Displays Information with Regards to the DPF Soot Accumulated.

Figure 17:
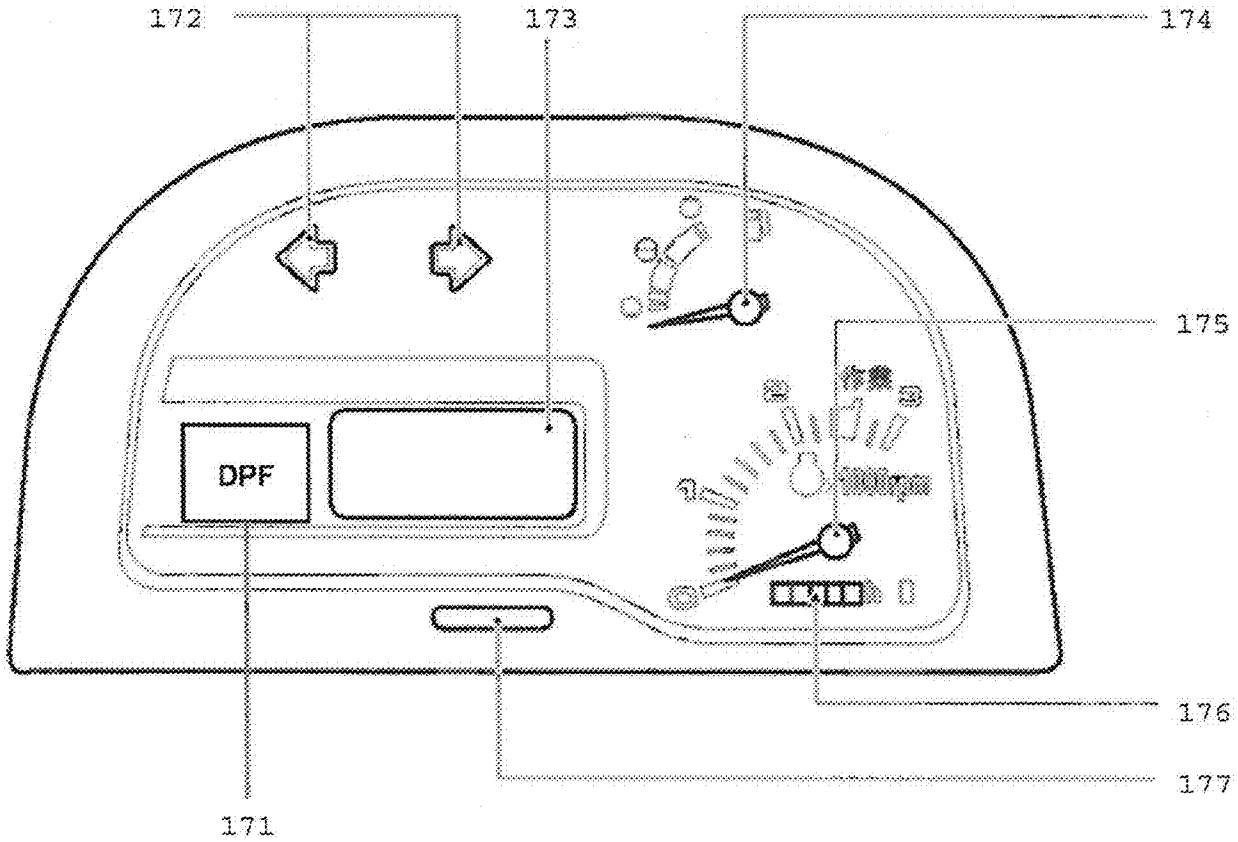
FIG. 17 is an illustrative drawing of the method of Embodiment 1 in the present invention of adding the dedicated liquid crystal panel that displays information with regards to the DPF soot accumulated.

Mainly referring to FIG. 17, descriptions are given regarding the method of adding the dedicated liquid crystal panel 171 that displays information with regards to the DPF soot accumulated.

Herein, FIG. 17 is an illustrative drawing of the method of Embodiment 1 in the present invention of adding the dedicated liquid crystal panel 171 that displays information with regards to the DPF soot accumulated.

If information with regards to the DPF soot accumulated is displayed on the liquid crystal panel that is called MALUCHIAI (Japanese KATAKANA Registered Trademark) in the HFZ (Japanese Registered Trademark) instrumental panel, since there is a limit in information such that it is possible to carry out displaying thereof with one liquid crystal panel, it is occasionally impossible for a user to easily understand the displayed information.

Thereupon, in the instrumental panel of an agricultural machine such as a combine harvester or the like into which an engine with a DPF conforming to regulations such as Tier4 and the like is loaded, for the purpose of displaying the DPF stage and the like by a gauge that blinks when excess accumulation is being generated, the dedicated liquid crystal panel 171 may be additionally provided along with the winker pilot lamp 172, the MALUCHIAI 173, the fuel meter 174, the engine tachometer 175, the hour meter 176 and the alarm 177.

G. Methods of More Surely Allowing the User to Recognize that Excess Accumulation is being Generated in the DPF.

Figure 18:
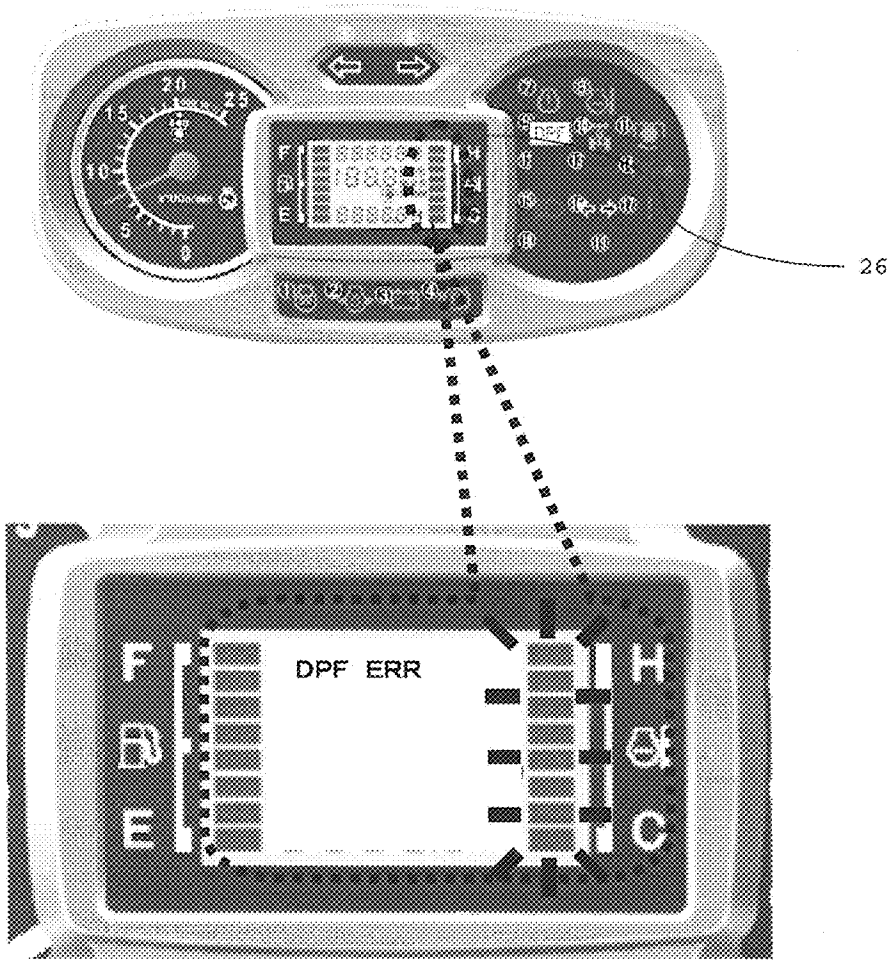
FIG. 18 is an illustrative drawing of the instrumental panel displaying at the time of excess accumulation generation of Embodiment 1 in the present invention.

Mainly referring to FIG. 18, descriptions are given regarding the method of more surely allowing the user to recognize that excess accumulation is being generated in the DPF 11.

Herein, FIG. 18 is an illustrative drawing of the instrumental panel displaying at the time of excess accumulation generation of Embodiment 1 in the present invention.

If it is possible to allow in an early stage the user to recognize that excess accumulation is being generated in the DPF 11, as has been described above, since it is possible to use service regeneration processing, there is a possibility that repair costs become unnecessary that accompany a DPF exchange with many man-hours by a dealer.

However, the user, rarely gazing at the instrumental panel during work when he must grasp the state of the agricultural machine and surroundings, occasionally fails to recognize that excess accumulation is being generated.

Thereupon, since it is highly possible that an alert of excess accumulation only by monochrome bar displaying for example gets overlooked, the whole of the meter gauge may be allowed to blink with good visibility while the meter gauge indication that corresponds to the accumulation degree is maximized at the time of excess accumulation of the DPF 11.

H. Methods of More Surely Allowing the User to Recognize that Regeneration Processing of the DPF is Being Prohibited.

Figure 19:
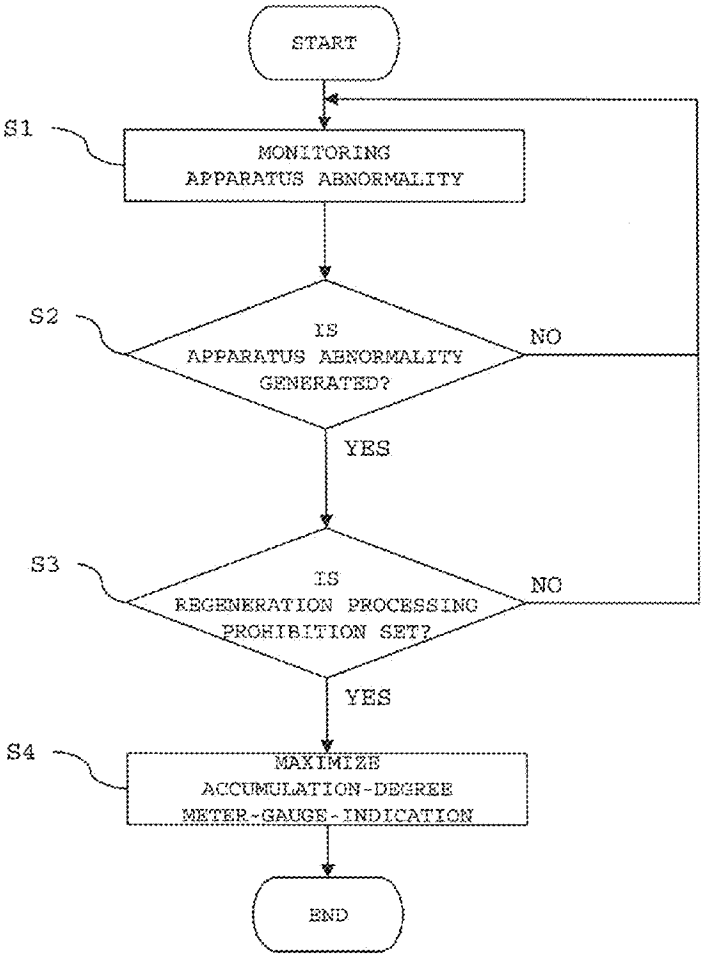
FIG. 19 is a flow diagram that describes the method of Embodiment 1 in the present invention of more surely allowing the user to recognize that regeneration processing of the DPF is being prohibited.

Mainly referring to FIG. 19, descriptions are given regarding the method of more surely allowing the user to recognize that regeneration processing of the DPF 11 is being prohibited.

Herein, FIG. 19 is a flow diagram that describes the method of Embodiment 1 in the present invention of more surely allowing the user to recognize that regeneration processing of the DPF 11 is being prohibited.

When abnormality of apparatuses like sensors such as a DPF pressure difference sensor, an exhaust temperature sensor and the like, and an intake air throttle valve, which are important to regeneration processing of the DPF 11 to be conducted or controlled, is being generated, controlling to positively prohibit regeneration processing by the engine controller is conducted.

Of course, a notification that abnormality of apparatuses is being generated is given by an alert lamp or the like but, if the user does not recognize it, utilization will be, even if the soot is accumulated to the range where regeneration processing is necessitated, continued as it is, and there is a high risk that the accumulation amount of the soot in the DPF 11 reaches the excess accumulation range.

Thereupon, for the purpose of more strongly attracting attention of the user to the instrumental panel, when regeneration processing of the DPF is being prohibited, the meter gauge indication that corresponds to the accumulation degree may be forcibly maximized.

More specifically, in the instrumental panel of an agricultural machine into which a common rail engine with a DPF is loaded, apparatus abnormality is monitored (Step S1), it is judged whether apparatus abnormality is being generated (Step S2), if apparatus abnormality is being generated, it is judged whether a setting has been done such that regeneration processing is prohibited at the time of apparatus abnormality generation (Step S3) and, if the setting has been done such that regeneration processing is prohibited at the time of apparatus abnormality generation, the meter gauge indication that corresponds to the accumulation degree is maximized.

Embodiment 2

Figure 20:
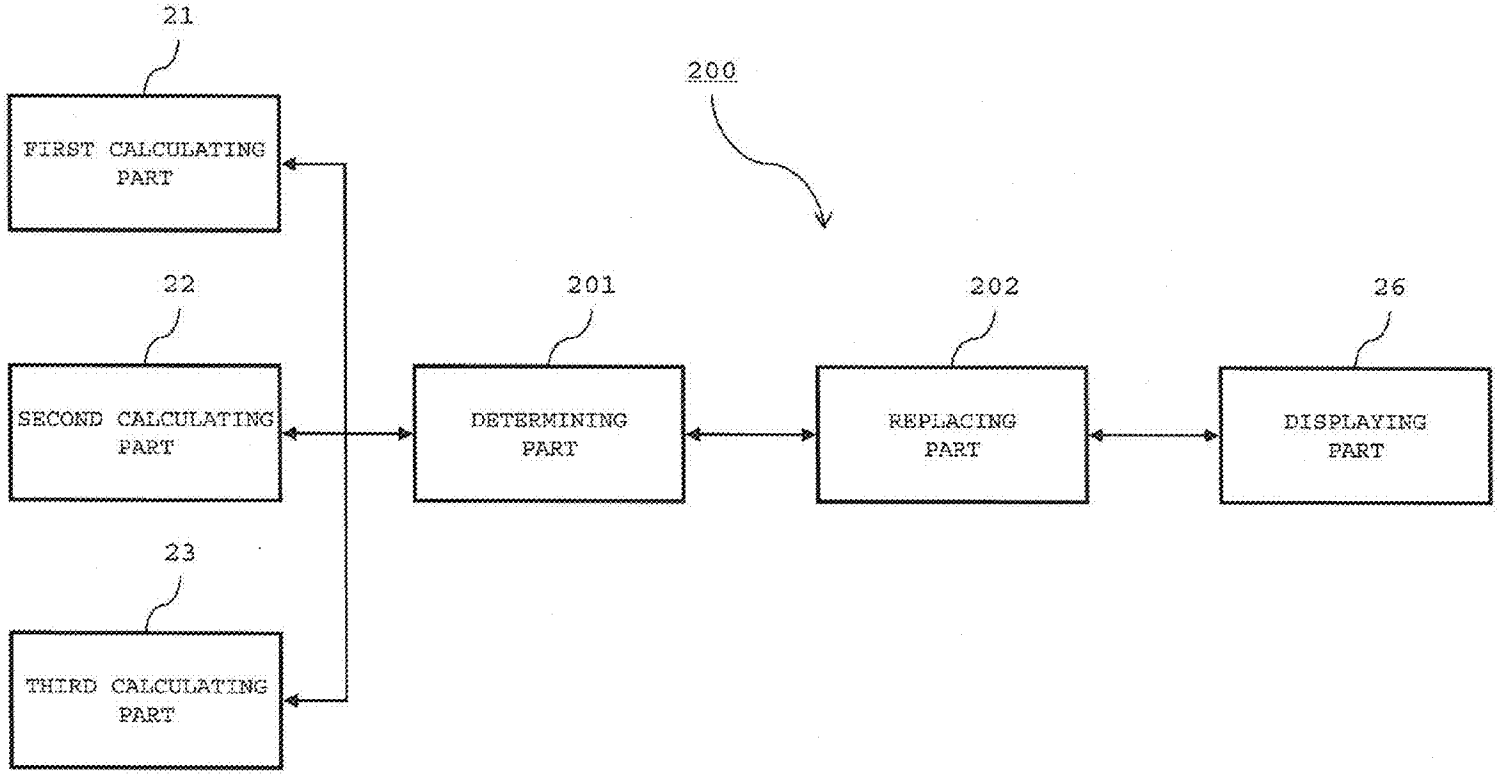
FIG. 20 is a schematic block diagram of the soot accumulation computing and displaying device of Embodiment 2 in the present invention.

Next, mainly referring to FIG. 20, descriptions are given regarding the configuration and action of the soot accumulation computing and displaying device 200 of Embodiment 2.

Herein, FIG. 20 is a schematic block diagram of the soot accumulation computing and displaying device 200 of Embodiment 2 in the present invention.

The configuration and action of the soot accumulation computing and displaying device 200 is analogous to the configuration and action of the soot accumulation computing and displaying device 20 of Embodiment 1, and variants like the above are similarly applicable.

Hereupon, the soot accumulation computing and displaying device 20 of Embodiment 1 has performed the MAX selection after the conversion from the inferred value into the accumulation degree, but the soot accumulation computing and displaying device 200 performs the conversion from the inferred value into the accumulation degree after the MAX selection.

Of course, since a larger inferred value is converted into a larger accumulation degree, final displaying consequences are the same, if the preconditions are the same, regardless of order of the conversion and MAX selection, which is also obvious from the descriptions in the following.

The soot accumulation computing and displaying device 200 is a computing and displaying device that performs displaying of information with regards to the accumulation amount of soot in the DPF 11 (see FIG. 1) provided in the flow path of the exhaust gas from the internal-combustion engine.

The soot accumulation computing and displaying device 200 comprises the first calculating part 21, the second calculating part 22, the third calculating part 23, the determining part 201, the replacing part 202, and the displaying part 26.

The determining part 201 is a means that determines the maximum inferred value among all or part of the first, second and third inferred values.

The replacing part 202 is a means that replaces the maximum inferred value with a corresponding accumulation degree.

Figure 21:
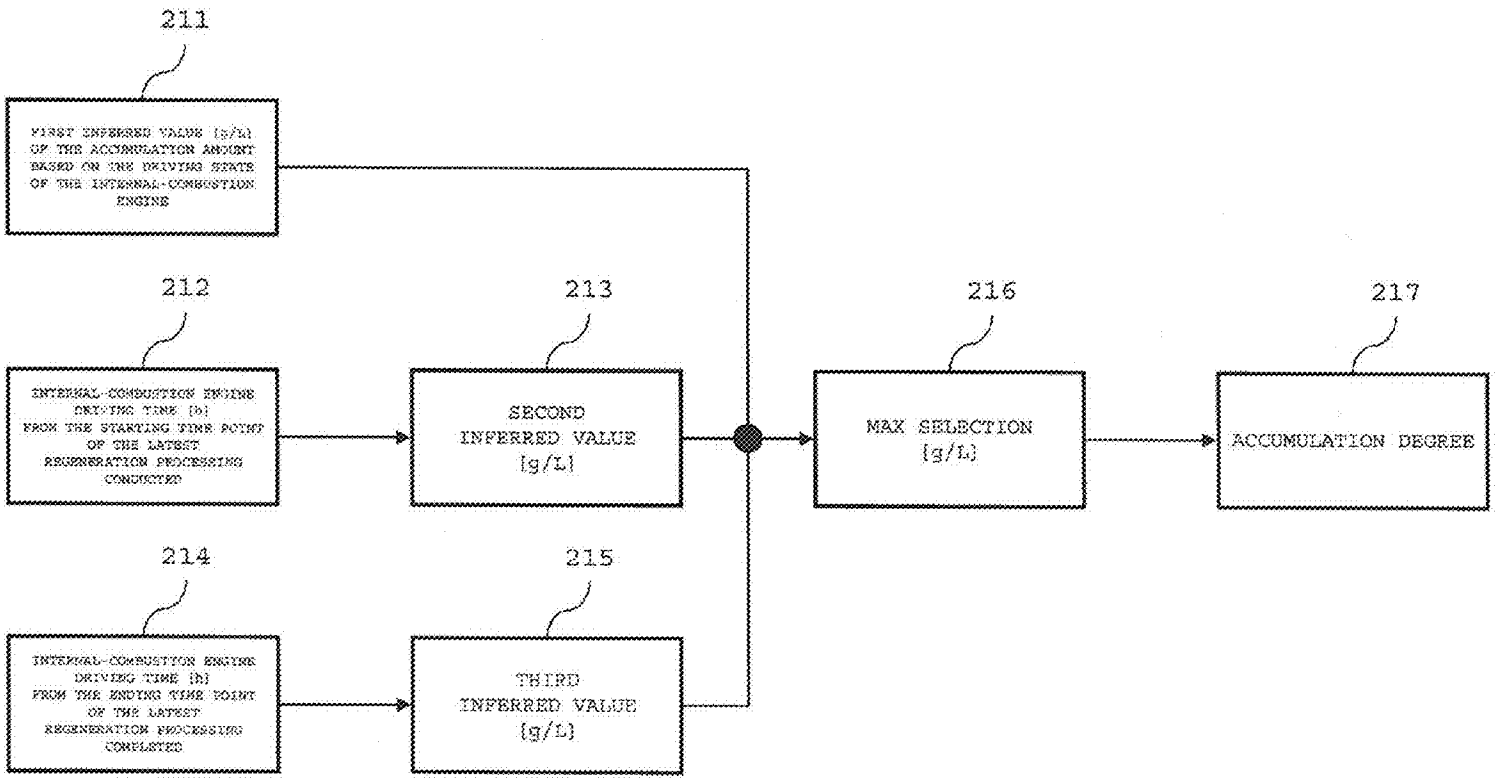
FIG. 21 is an illustrative drawing of the action of the soot accumulation computing and displaying device of Embodiment 2 in the present invention.
Figure 22:
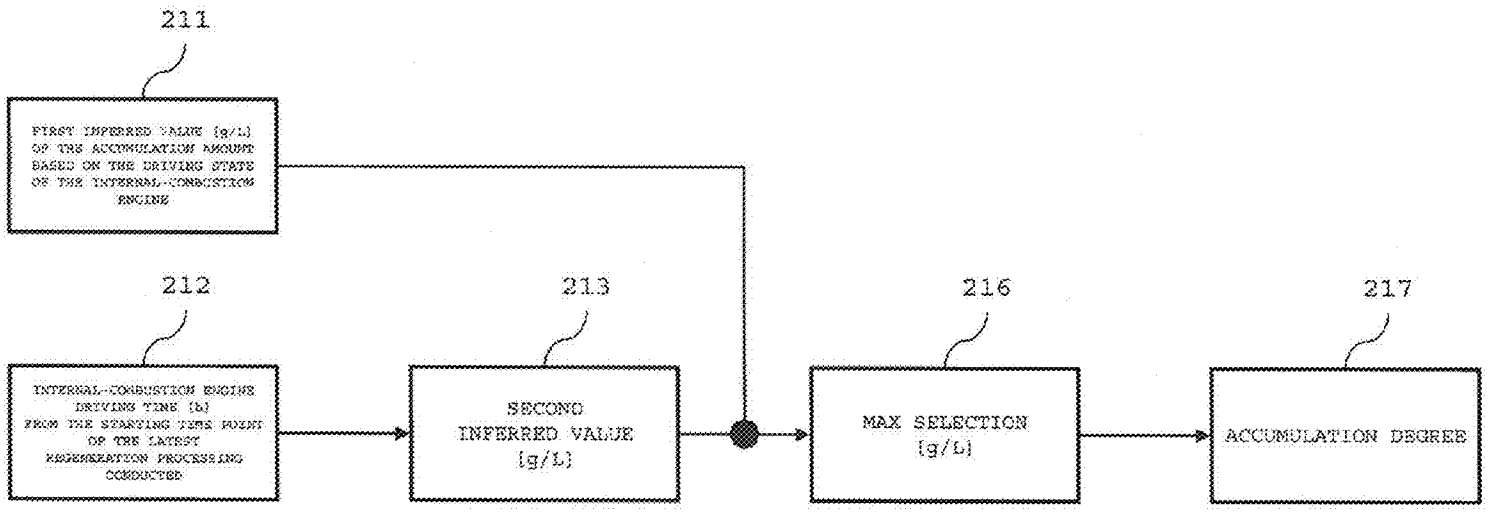
FIG. 22 is an illustrative drawing of the action of the soot accumulation computing and displaying device of Embodiment 2 in the present invention, which is performed when manual regeneration processing that corresponds to the instruction from the user is being conducted.

Next, mainly referring to FIG. 21 and FIG. 22, more specific descriptions are given regarding the action of the soot accumulation computing and displaying device 200 of the present embodiment.

Herein, FIG. 21 is an illustrative drawing of the action of the soot accumulation computing and displaying device 200 of Embodiment 2 in the present invention, and FIG. 22 is an illustrative drawing of the action of the soot accumulation computing and displaying device 200 of Embodiment 2 in the present invention, which is performed when manual regeneration processing that corresponds to the instruction from the user is being conducted.

As shown in FIG. 21, the first inferred value [g/L] 211 of the accumulation amount based on the driving state of the internal-combustion engine is obtained by the first calculating part 21 (see FIG. 20).

Next, the second inferred value [g/L] 213 of the accumulation amount is, corresponding to the internal-combustion engine driving time [h] 212 from the starting time point of the latest regeneration processing conducted, obtained by the second calculating part 22 (see FIG. 20).

Next, the third inferred value [g/L] 215 of the accumulation amount is, corresponding to the internal-combustion engine driving time [h] 214 from the ending time point of the latest regeneration processing completed, obtained by the third calculating part 23 (see FIG. 20).

And, the MAX selection 216 that determines the maximum inferred value among the first to third inferred values 211, 213 and 215 is performed by the determining part 201 (see FIG. 20).

Further, that maximum inferred value is converted into the corresponding accumulation degree 217 (non-dimensionalization) by the replacing part 202 (see FIG. 20).

As a consequence, the accumulation degree 217 corresponding to the maximum inferred value is displayed by the displaying part 26 (see FIG. 20) with a bar or the like using CAN message sending or the like.

Since the accumulation degree corresponding to the maximum inferred value among the first to third inferred values is determined, there is no fear of underestimates of the soot accumulation, and it is possible to surely conduct necessary regeneration processing at an appropriate timing.

Hereupon, when manual regeneration processing that corresponds to the instruction from the user is being conducted, another processing is performed. That is to say, as shown in FIG. 22, the determining part 201 determines the maximum inferred value among the first and second inferred values.

Of course, the maximum inferred value among the first, second and third inferred values has been determined but, instead, for example, the maximum inferred value among the first and second inferred values may be determined, and the maximum inferred value among the first and third inferred values may be determined.

EMBODIMENT OF THE INVENTION RELATED TO THE PRESENT INVENTION

Figure 23:
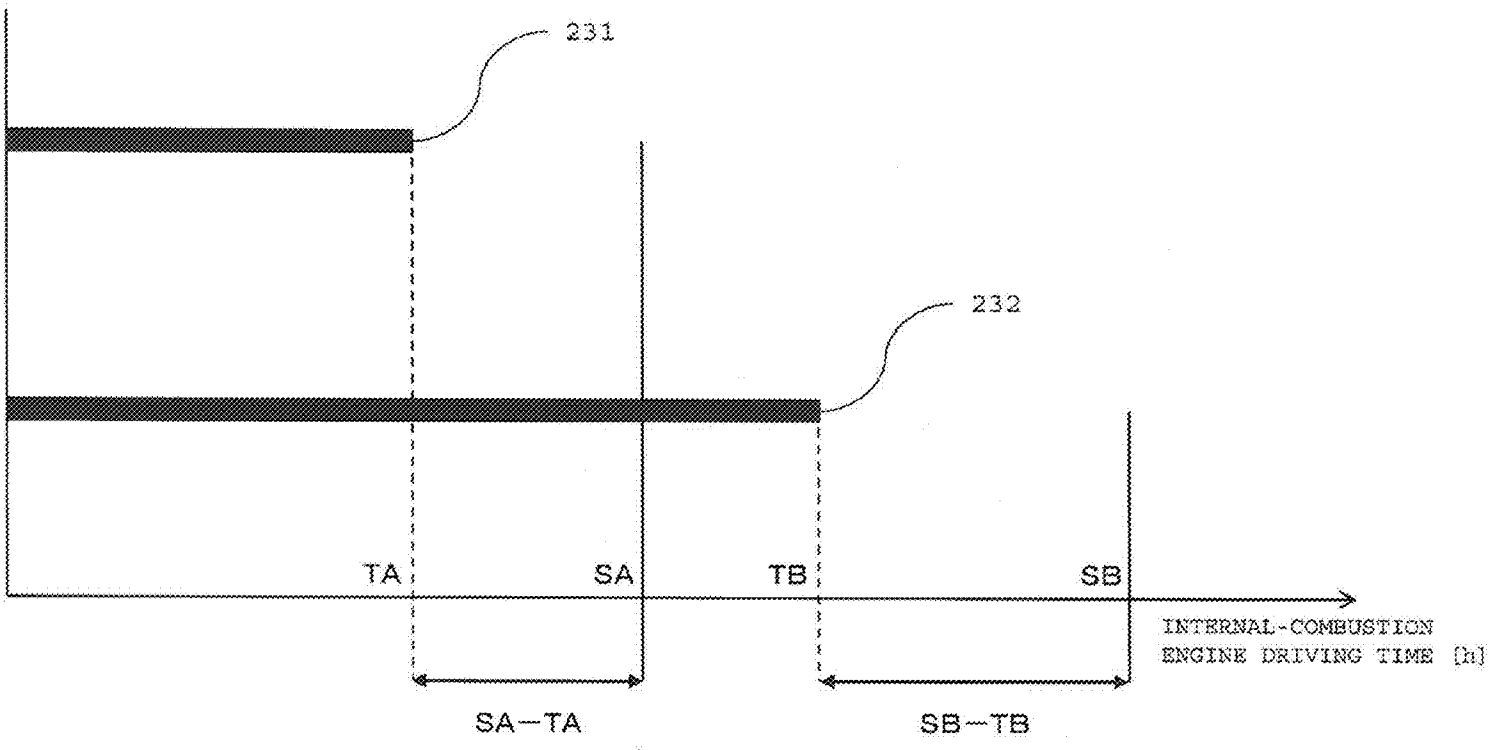
FIG. 23 is an illustrative drawing of the time of Embodiment of the Invention Related to the Present Invention until the arrival of the timing when the manual-regeneration-processing button should be pressed down.

Next, mainly referring to FIG. 23, descriptions are given regarding the soot accumulation computing and displaying method of Embodiment of the Invention Related to the Present Invention.

Herein, FIG. 23 is an illustrative drawing of the time of Embodiment of the Invention Related to the Present Invention until the arrival of the timing when the manual-regeneration-processing button should be pressed down.

Since direct visual recognition of a phenomenon that PM is accumulated in the DPF 11 (see FIG. 1) is impossible, it is occasionally difficult for a user who is not very good at scientific thinking to understand the meaning of the phenomenon that PM is accumulated in the DPF 11.

Thereupon, for the purpose of improving convenience to a variety of users, the user may be allowed to recognize the time until the arrival of the timing when the manual-regeneration-processing button should be pressed down that is easy to understand in comparison with the accumulation degree and the like.

More specifically, (1) from the increasing tendency of the inferred value [g/L] of the accumulation amount based on the driving state of the internal-combustion engine, calculated is the remaining time Δ[h] until the time point when that inferred value is expected to reach the threshold value [g/L] such that the manual-regeneration-processing button should be pressed down, (2) calculated is the remaining time SA-TA[h] until the time point when the internal-combustion engine driving time TA[h] from the starting time point of the latest regeneration processing among the regeneration processings of the DPF 11 conducted is expected to reach the threshold value SA[h] such that the manual-regeneration-processing button should be pressed down, (3) calculated is the remaining time SB-TB[h] until the time point when the internal-combustion engine driving time TB[h] from the ending time point of the latest regeneration processing among the regeneration processings of the DPF 11 completed is expected to reach the threshold value SB[h] such that the manual-regeneration-processing button should be pressed down, (4) determined is the minimum remaining time [h] among the remaining time Δ[h], the remaining time SA-TA[h] and the remaining time SB-TB[h], and (5) displayed is the minimum remaining time [h].

Regarding the specific example that is shown in FIG. 7, the details are as follows.

That is to say, it is deemed that the above-mentioned threshold value [g/L] such that the manual-regeneration-processing button should be pressed down should be a parameter that depends on the characteristics or the like of the DPF 11 and internal-combustion engine, and is here the parameter C, which coincides with the lower-side threshold value of the numerical range that is used for the purpose of defining the accumulation degree 12 to which the manual-regeneration-processing range (former period) corresponds.

Thereupon, displayed is the minimum remaining time [h] among the remaining time Δ[h] until the time point when the inferred value [g/L] of the accumulation amount based on the driving state of the internal-combustion engine is expected to reach the threshold value [g/L] corresponding to the generation of the accumulation degree 12, the remaining time SA-TA[h] until the indication of the internal-combustion engine driving time SA[h] corresponding to the generation of the accumulation degree 12 by the timer 231 that is indicating the internal-combustion engine driving time TA[h], and the remaining time SB-TB[h] until the indication of the internal-combustion engine driving time SB[h] corresponding to the generation of the accumulation degree 12 by the timer 232 that is indicating the internal-combustion engine driving time TB[h].

A soot accumulation computing and displaying device in the present invention is capable of conducting at a more appropriate timing regeneration processing of a filter provided in a flow path of an exhaust gas from an internal-combustion engine, and is useful for the purpose of being used as a soot accumulation computing and displaying device that is used for regeneration processing of a filter provided in a flow path of an exhaust gas from an internal-combustion engine, such that there is no fear of underestimates of the soot accumulation of the filter.

What is claimed is:

1. A soot accumulation computing and displaying device loaded into a vehicle, which is configured to perform displaying of information with regards to an accumulation amount of soot in a filter provided in a flow path of an exhaust gas from an internal-combustion engine, comprising:

a first calculating processor that is configured to calculate a first inferred value of a present accumulation amount of the soot, based on a main fuel injection amount having contributed to driving of the internal-combustion engine, and a post fuel injection amount having contributed to regeneration processing of the filter, both of the fuel injection amounts being detected between a present time and an ending time of a latest regeneration processing of the filter among regeneration processings of the filter completed in past;

a first timer that is configured to detect a driving time of the internal-combustion engine, which is detected to the present time from a starting time of the latest regeneration processing of the filter among the regeneration processings of the filter conducted in past;

a second calculating processor that is configured to calculate a second inferred value of the present accumulation amount of the soot corresponding to the driving time detected by the first timer, based on a first relation, which has been found beforehand, between the driving time of the internal-combustion engine and the accumulation amount of the soot;

a determining processor that is configured to determine a maximum inferred value among the first and second inferred values; and a displaying part that is configured to perform displaying with regards to the maximum inferred value determined by the determining processor.

2. A soot accumulation computing and displaying device according to claim 1, wherein the displaying part is further configured to display a cooling water temperature of the internal-combustion engine.

3. A soot accumulation computing and displaying device loaded into a vehicle, which is configured to perform displaying of information with regards to an accumulation amount of soot in a filter provided in a flow path of an exhaust gas from an internal-combustion engine, comprising:

a first calculating processor that is configured to calculate a first inferred value of a present accumulation amount of the soot, based on a main fuel injection amount having contributed to driving of the internal-combustion engine, and a post fuel injection amount having contributed to regeneration processing of the filter, both of the fuel injection amounts being detected between a present time and an ending time of a latest regeneration processing of the filter among regeneration processings of the filter completed in past;

a second timer that is configured to detect a driving time of the internal-combustion engine, which is detected to the present time from the ending time of the latest regeneration processing of the filter among the regeneration processings of the filter completed in past;

a third calculating processor that is configured to calculate a third inferred value of the present accumulation amount of the soot corresponding to the driving time detected by the second timer, based on a second relation, which has been found beforehand, between the driving time of the internal-combustion engine and the accumulation amount of the soot;

a determining processor that is configured to determine a maximum inferred value among the first and third inferred values; and a displaying part that is configured to perform displaying with regards to the maximum inferred value determined by the determining processor.

4. A soot accumulation computing and displaying device according to claim 3, wherein the displaying part is further configured to display a cooling water temperature of the internal-combustion engine.

5. A soot accumulation computing and displaying device loaded into a vehicle, which is configured to perform displaying of information with regards to an accumulation amount of soot in a filter provided in a flow path of an exhaust gas from an internal-combustion engine, comprising:

a first calculating processor that is configured to calculate a first inferred value of a present accumulation amount of the soot, based on a main fuel injection amount having contributed to driving of the internal-combustion engine, and a post fuel injection amount having contributed to regeneration processing of the filter, both of the fuel injection amounts being detected between a present time and an ending time of a latest regeneration processing of the filter among regeneration processings of the filter completed in past;

a first timer that is configured to detect a first driving time of the internal-combustion engine, which is detected to the present time from a starting time of the latest regeneration processing of the filter among the regeneration processings of the filter conducted in past;

a second calculating processor that is configured to calculate a second inferred value of the present accumulation amount of the soot corresponding to the first driving time detected by the first timer, based on a first relation, which has been found beforehand, between the first driving time of the internal-combustion engine and the accumulation amount of the soot;

a second timer that is configured to detect a second driving time of the internal-combustion engine, which is detected to the present time from the ending time of the latest regeneration processing of the filter among the regeneration processings of the filter completed in past;

a third calculating processor that is configured to calculate a third inferred value of the present accumulation amount of the soot corresponding to the second driving time detected by the second timer, based on a second relation, which has been found beforehand, between the second driving time of the internal-combustion engine and the accumulation amount of the soot;

a determining processor that is configured to determine a maximum inferred value among the first, second and third inferred values; and a displaying part that is configured to perform displaying with regards to the maximum inferred value determined by the determining processor.

6. A soot accumulation computing and displaying device according to claim 5, wherein the displaying part is further configured to display a cooling water temperature of the internal-combustion engine.

* * * * *